US010960704B2

(12) United States Patent
Czichos et al.

(10) Patent No.: US 10,960,704 B2
(45) Date of Patent: Mar. 30, 2021

(54) METHOD FOR PRODUCING A MULTILAYER FILM AND MULTILAYER FILM AS WELL AS A SECURITY ELEMENT AND A SECURITY DOCUMENT

(71) Applicant: LEONHARD KURZ Stiftung & Co. KG, Fürth (DE)

(72) Inventors: Michael Czichos, Cadolzburg (DE); Haymo Katschorek, Obermichelbach (DE); Klaus Pforte, Oberasbach (DE)

(73) Assignee: LEONHARD KURZ STIFTUNG & CO. KG, Furth (DE)

( * ) Notice: Subject to any disclaimer, the term of this patent is extended or adjusted under 35 U.S.C. 154(b) by 0 days.

(21) Appl. No.: 16/498,580

(22) PCT Filed: Mar. 26, 2018

(86) PCT No.: PCT/EP2018/057619
§ 371 (c)(1),
(2) Date: Sep. 27, 2019

(87) PCT Pub. No.: WO2018/178000
PCT Pub. Date: Oct. 4, 2018

(65) Prior Publication Data

US 2020/0070566 A1 Mar. 5, 2020

(30) Foreign Application Priority Data

Mar. 29, 2017 (DE) ..... 102017106721.3

(51) Int. Cl.
*B42D 25/41* (2014.01)
*B42D 25/328* (2014.01)
(Continued)

(52) U.S. Cl.
CPC ..... *B42D 25/41* (2014.10); *B42D 25/328* (2014.10); *B42D 25/47* (2014.10)

(58) Field of Classification Search
CPC ..... B42D 25/41; B42D 25/328; B42D 25/47; B42D 25/425
(Continued)

(56) References Cited

U.S. PATENT DOCUMENTS

2012/0156446 A1 6/2012 Brehm et al.
2013/0285361 A1 10/2013 Staub et al.
(Continued)

FOREIGN PATENT DOCUMENTS

DE 102010050031 A1 5/2012
DE 102013113283 A1 6/2015
(Continued)

OTHER PUBLICATIONS

International Standard 5033, "Continuous Mechanical Handling Equipment for Loose Bulk Materials—Rotary Drum Feeders and Rotary Vane Feeders—Safety Code", Ref. No. ISO 5033-1977 (E); pp. 1-3.
(Continued)

*Primary Examiner* — Justin V Lewis
(74) *Attorney, Agent, or Firm* — Hoffmann & Baron, LLP

(57) ABSTRACT

A method for producing a multilayer film wherein, in at least one step, at least one ink is applied to a layer by means of inkjet printing, whereby at least one area at least of a first print is provided, and wherein the first print is covered by at least one further layer. A multilayer film, in particular produced by a method according to the invention, having at least a first print, wherein the print is produced by means of inkjet printing and wherein the print is arranged within the multilayer film and is covered by further layers of the multilayer film.

42 Claims, 6 Drawing Sheets

(51) Int. Cl.
*B42D 25/47* (2014.01)
*B42D 25/425* (2014.01)

(58) Field of Classification Search
USPC ..... 283/67, 70, 72, 74, 94, 98, 901
See application file for complete search history.

(56) References Cited

U.S. PATENT DOCUMENTS

| | | | | |
|---|---|---|---|---|
| 2016/0075167 | A1 | 3/2016 | Cruikshank et al. | |
| 2017/0028765 | A1 | 2/2017 | Staub et al. | |
| 2017/0066279 | A1* | 3/2017 | Karrer Walker | B42D 25/21 |
| 2017/0313121 | A1* | 11/2017 | Schilling | B42D 25/24 |
| 2018/0215190 | A1 | 8/2018 | Reuther | |

FOREIGN PATENT DOCUMENTS

| | | | | |
|---|---|---|---|---|
| DE | 102014106340 | A1 | 11/2015 | |
| DE | 102015112909 | B3 | 2/2017 | |
| DE | 102015226603 | A1 | 6/2017 | |
| DE | 102016201709 | A1 | 8/2017 | |
| WO | 2011006634 | A2 | 1/2011 | |
| WO | 2014184188 | A1 | 11/2014 | |
| WO | 2016092040 | A1 | 6/2016 | |
| WO | WO-2016092040 | A1 * | 6/2016 | B42D 25/324 |

OTHER PUBLICATIONS

International Standard 2496, "Butyl Alcohol for Industrial Use—List of Methods of Test", Ref. No. ISO 2496-1973 (E); pp. 1-4.
Deutsche Normen, "Colorimetric Evaluation of Colour Differences of Surface Colours According to the CIELAB Formula", DIN 6174; pp. 1-2; 1979.
Deutsche Norm, "General Methods of Test for Pigments and Extenders: Part 10: Determination of Density Pyknometer Method", DIN EN ISO 787-10; pp. 1-7; 1983.
Deutsche Norm, "General Methods of Test for Pigments and Extenders: Part 5: Determination of Oil Absorption Value", DIN EN ISO 787-5; pp. 1-5; 1983.
International Search Report dated Aug. 16, 2018.
German Examination Report dated Dec. 22, 2017.

* cited by examiner

METHOD FOR PRODUCING A MULTILAYER FILM AND MULTILAYER FILM AS WELL AS A SECURITY ELEMENT AND A SECURITY DOCUMENT

This application claims priority based on an International Application filed under the Patent Cooperation Treaty, PCT/EP2018/057619, filed Mar. 26, 2018, which claims priority to DE 102017106721.3, filed Mar. 29, 2017.

BACKGROUND OF THE INVENTION

The invention relates to a method for producing a multilayer film, as well as a multilayer film. Furthermore, a subject of the invention is a security element, as well as a security document, in particular a banknote, security, identification document, visa document, passport or credit card, with a multilayer film.

The individualization of multilayer films, in particular with respect to their optical appearance, is generally known. Multilayer-film blanks are provided for this. The individualization is then effected in a step taking place after the provision of the multilayer films. It is thus in particular a retrospective individualization. In this case the individualizing features are applied at least to an outside of the multilayer films. In particular, the individualization is effected shortly after the application of the multilayer films to a substrate. It is disadvantageous here that the individualization features are located on the surface of the multilayer films, with the result that these can easily be damaged—both deliberately and unintentionally.

SUMMARY OF THE INVENTION

The object of the present invention is thus to specify an improved method as well as a multilayer film obtainable therewith, through which the named disadvantages are reduced or avoided. In particular, the protection against forgery as well as the stability are to be improved.

The object is by a method for producing a multilayer film wherein, in at least one step, at least one ink is applied to a layer by means of inkjet printing, whereby at least one area at least of a first print is provided, and wherein the first print is covered by at least one further layer. An individualized print is preferably provided.

The steps are advantageously effected in the specified sequence.

The object is further achieved by a multilayer film, in particular obtainable by a method according to the invention, having at least a first print, wherein the print is produced by means of inkjet printing and wherein the print is arranged within the multilayer film and is covered by further layers of the multilayer film.

Furthermore, a subject of the invention is a security element, as well as a security document, in particular a banknote, security, tax sticker, ticket, official seal, identification document, visa document, passport or credit card, with a multilayer film according to the invention.

Through the application of the ink according to the invention, a method is obtained with which a multilayer film can be adapted quickly and simply to individual wishes and requirements. The multilayer film is thus used in a wide range of applications. In particular the method or the multilayer film is eminently suitable for producing a security element or a security document. The multilayer film can be part of a security document, such as for example a banknote, an identification document or the like.

The print is not limited to any specific arrangement within the multilayer film. Through this discretionary positioning of the ink or of the print within the multilayer film, an interplay can be achieved, in particular an optical interplay of the at least one print with the further layers of the multilayer body and/or with further optical features or optical elements of the multilayer film, in particular with optically variable elements. Thus, for example, color overlays and/or also color interactions can be caused or brought about.

In addition, desired predetermined breaking points in the multilayer body and/or locally modified diffractive structures can be realized through the print.

Because the print is arranged within the multilayer film, the print is demarcated or isolated from the environment. This offers the advantage that the print is protected against mechanical influences, such as for example against mechanical abrasion on the surface which can be caused both deliberately and through simple use. Furthermore, the manipulation of the print is also made difficult, as a manipulation can only be effected in conjunction with damage to the further layers of the multilayer film.

Within the meaning of the invention, by an ink is meant in particular a printing ink, a varnish, an adhesive and/or an ink. The ink is preferably a liquid or paste which can be printed in particular with printing methods, for example inkjet printing, gravure printing, flexographic printing or screen printing. After application, the ink can be dried and/or cured thermally, oxidatively and/or by means of radiation, in particular by means of electromagnetic radiation.

By an ink can also be meant, in principle, a dry, liquid or paste-like toner material which can be printed by means of xerographic printing methods. By an ink can, moreover, be meant a dry material, in particular in the form of a transfer ply of a transfer film, for example a thermal transfer film, which can be printed in particular by means of transfer methods, for example in a thermal transfer printer.

In principle, the ink according to the invention is not limited to any specific embodiment. The ink can be formed transparent, translucent, opaque, invisible, colored and/or colorless. Likewise, in principle, the print is not limited to any specific embodiment. The print can be formed transparent, translucent, opaque, invisible, colored and/or colorless.

In the present case, by transparent is meant in particular an area with a transmissivity in the wavelength range of light visible to a human observer of more than 50%, preferably of more than 70%, particularly preferably of more than 80%.

In the present case, by opaque is meant in particular an area with a transmissivity in the wavelength range of light visible to a human observer of less than 40%, preferably of less than 30%, particularly preferably of less than 20%.

It is also conceivable that the print has a luminance L* in the CIELAB color space of from 0 to 50, preferably from 0 to 30.

The luminance L* of the layer used is determined in particular by means of the CIELAB Datacolor SF 600 measuring system which is based on a spectrophotometer. In the colorimetric determination of color distances in body colors according to the CIELAB L*a*b* formula, the value L* stands for the light/dark axis, the value a* for the red/green axis and the value b* for the yellow/blue axis. The L*a*b* color space is thus described as a three-dimensional coordinate system, wherein the L* axis describes the lightness and can assume a value between 0 and 100.

The measurement of the lightness L* is preferably effected under the following conditions:

Measurement geometry: diffuse/8° according to DIN 5033 and ISO 2496

Diameter of measurement opening: 9 mm

Spectral range: 360 nm to 700 nm according to DIN 6174

Standard illuminant: D65

In the present case, by invisible is meant in particular something that is not perceptible to the human eye.

Colored inks are preferably provided. Color effects and/or, in the case of already-colored films, additional color effects can hereby be introduced into the multilayer film.

The ink can also be formed in such a way that the ink or the print provided by means of the ink substantially absorbs incident radiation and/or light. The ink or the print formed therefrom preferably has a dark appearance. The ink is preferably formed substantially black and/or dark-colored and/or opaque.

Furthermore, as a special form of colored inks, inks with metal pigments or pigments with a metallic appearance such as e.g. mica which are preferably embedded in a binder, are also conceivable, wherein these pigments preferably reflect incident radiation to a greater extent and thus contrast with their surroundings.

Furthermore, the provision of luminescent inks, both transparent and colored luminescent ink, fluorescent inks, both transparent and colored fluorescent ink, phosphorescent including chemoluminescent inks, both transparent and colored phosphorescent inks, and/or liquid crystalline inks, in particular with dichroic color effects and/or laser-sensitive inks and/or inks with taggants, whereby the addition of an additional machine-readability can be achieved, is also conceivable.

Both light-curing, in particular UV-curing inks, and solvent and/or aqueous inks can be used.

The thickness of the ink layer applied or printed preferably lies between 0.1 μm and 30 μm, in particular between 0.5 μm and 15 μm, particularly preferably between 0.5 μm and 15 μm and advantageously between 1 μm and 8 μm. If solvent and/or aqueous inks are used, then the layer thickness is preferably approximately 0.5 μm. If UV-curing inks are used, then the layer thickness is approximately between 1 μm and 30 μm, preferably between 1 μm and 15 μm, particularly preferably between 1 μm and 8 μm.

The print is preferably formed through the application of a single ink. A multilayer film is thus obtained, which has a print which is formed only by a single ink.

Here, it is in principle conceivable that in a subsequent step the print is further processed, in particular irradiated, at least in areas. The optical appearance of the print is hereby changed in these areas. A print can thus be obtained which—although it consists of only a single ink—comprises at least two areas which differ from each other in their optical appearance. The print can thus preferably have at least one visible and at least one invisible area.

The print can also be formed through the application of several inks, in particular inks formed differently from each other. The several inks differ from each other in particular in their optical appearance and/or their composition. The inks can thus, for example, differ from each other in their color. However, it is also conceivable that at least one of the inks used is transparent and/or invisible and at least one other ink used is formed opaque and/or visible. The inks can preferably be printed next to each other, one on top of the other or also overlapping.

In an optionally subsequent step, during use of a corresponding ink, it is possible for the print to be processed and/or irradiated at least in areas, in particular in that area where the transparent ink is located. The transparent or invisible ink can hereby become visible and preferably complement a partial motif or the like produced by the visible or opaque ink, whereby in particular an overall motif emerges.

If several, in particular differently formed, inks are applied in order to provide the at least one print, then the inks can be arranged next to each other, in particular directly next to each other, or overlapping at least in areas. The inks can however also be printed one on top of the other.

The application of the several inks can be effected both simultaneously and overlapping in time and also sequentially in time. In the case of inkjet printers, the application is preferably effected sequentially in time. In particular one color per head is printed. In particular, it is not possible in this case for several heads to be in the same place at the same time. In the Hewlett Packard Indigo method, for example, the final transfer of all the inks is effected simultaneously, as the print image is printed onto a transfer blanket beforehand or is built up there from individual single-colored inks and is only subsequently transferred from this transfer blanket onto the target substrate.

The application of the ink can be effected in-line, i.e. as an integrated step within the production of the film. An interim rolling-up and/or storage of the film preferably does not take place in this case. However, the application of the ink can in principle also be effected off-line and/or at any point in time. An interim rolling-up and/or storage of the film may have taken place here.

The ink is preferably applied to the layer in areas, in particular as part of a motif or as a motif.

Within the meaning of the invention, a motif can be, for example, a graphically formed outline, a figural representation, an image, a visually recognizable design element, a symbol, a logo, a portrait, a pattern, an alphanumeric character, a coding, a code pattern, a cryptographic pattern, a text, a color design and the like. The motif can also be formed individualized.

Within the meaning of the invention, by individualized is meant in particular that the print comprises items of information which are individually unique to each individual print, such as for example unique serial numbers. By individualized is also meant in particular that the print comprises items of information which are personalized and unique to the respective individual print, such as for example a unique date of birth, a unique tax identification number, pass number, personal identification number or the like. By individualized is in particular also meant that the print comprises items of information which are identical for a group of prints, but are in each case unique to each group of prints, for example a batch number. In the following, when the term print is used, an individualized print or also a non-individualized print can be meant by this.

However, it is in principle also possible for the ink to be applied to a layer over the whole surface. If the ink is applied to the layer over the whole surface, it is then advantageous if the optical appearance of the ink or of the print can still be changed at least in areas in a later step.

For producing the multilayer films, at least one of the following layers can be provided: at least one carrier layer, at least one detachment layer, at least one protective layer, in particular a protective varnish layer, at least one replication layer, at least one reflective layer, in particular a metallization or a metal layer or an HRI layer, and/or at least one adhesive layer and/or at least one primer layer. A multilayer film is thus obtained with at least one carrier layer, at least one detachment layer, at least one protective layer, at least one replication layer, at least one reflective layer, in particular at least one metallization of at least one metal layer and/or at least one HRI layer, and/or at least one adhesive layer and/or a primer layer. It is preferable if, in addition to a carrier layer, one of the following further layers is provided: at least one detachment layer, at least one protective layer, in particular a protective varnish layer, at least one replication layer, at least one reflective layer, in particular a metallization or a metal layer or an HRI layer, and/or at least one adhesive layer and/or at least one primer layer.

For special multilayer films, such as e.g. with thin film elements, yet further layers are optionally required, such as e.g. filter layers or spacer layers.

The carrier layer consists in particular of a material that is self-supporting and/or from the plastics class of substances. The carrier layer is preferably formed of PET, of a polyolefin, in particular of OPP, BOPP, MOPP, PP and/or PE, of PMMA, of PEN, of PA, of ABS and/or a composite material of these plastics. It is also possible for the carrier layer to have already been pre-coated by the manufacturer and for the multilayer film to be built up on this pre-coated material. It is also possible for the carrier layer to be a bio-degradable and/or compostable carrier layer. EVOH is preferably used in this case. The layer thickness of the carrier layer advantageously lies between 4 μm and 500 μm, in particular between 4.7 μm and 250 μm.

The multilayer film can be formed as a laminating film which has a carrier layer and a multilayer wear layer, for example a multilayer decorative ply, as well as an in particular heat-activatable adhesive layer, wherein carrier layer and wear layer are arranged together in the form of a stamping layer on the substrate.

In particular, the multilayer film is formed as a transfer film. A transfer film comprises in particular a transfer ply, which is preferably formed of several layers, in particular comprises at least one adhesive layer, one reflective layer, one replication layer and/or one protective layer, and a carrier layer, wherein the transfer ply is detachable from the carrier layer. To facilitate the detachment of the transfer ply, a detachment layer can be arranged between the transfer ply and the carrier layer.

The detachment layer ensures in particular that the layers of the multilayer film can, as transfer plies, be separated from the carrier layer non-destructively. The detachment layer is preferably formed of waxes, polyethylene (PE), polypropylene (PP), cellulose derivatives and/or poly(organo)slloxanes. Above-named waxes can be natural waxes, synthetic waxes or combinations thereof. Above-named waxes are, for example, camauba waxes. Above-named cellulose derivatives are, for example, cellulose acetate (CA), cellulose nitrate (CN), cellulose acetate butyrate (CAB) or mixtures thereof. Above-named poly(organo)siloxanes are, for example, silicone binders, polysiloxane binders or mixtures thereof. The detachment layer preferably has a layer thickness of between 1 nm and 500 nm, in particular a layer thickness of between 5 nm and 250 nm, in particular preferably between 10 nm and 250 nm.

When the multilayer film is used as laminating film, e.g. for label and/or sticker applications, the connection between carrier layer and subsequent layers or wear layer(s) remains unchanged as a rule during application. In the case of laminating films, in principle a detachment layer is therefore dispensed with, or designed e.g. in the case of laminating films for security applications such that a separation of the carrier layer from the wear layers preferably can only occur after the application.

The detachment layer can be produced with the known printing methods. In particular gravure printing, flexographic printing, screen printing, inkjet printing or by means of a slot die are suitable. The detachment layer can however also be formed by vapor deposition, physical vapor deposition (PVD), chemical vapor deposition (CVD) and/or sputtering.

The protective layer is preferably a layer of PMMA, PVC, melamines and/or acrylates. The protective varnish can also consist of a radiation-curing dual-cure varnish. This dual-cure varnish can be thermally pre-crosslinked in a first step during and/or after application in liquid form. Preferably, in a second step, in particular after the processing of the multilayer film, the dual-cure varnish is radically post-crosslinked, in particular via high-energy radiation, preferably UV radiation. Dual-cure varnishes of this type can consist of different polymers or oligomers, which have unsaturated acrylate or methacrylate groups. These functional groups can be radically crosslinked with each other, in particular in the second step. For the thermal pre-crosslinking in the first step it is advantageous that at least two or more alcohol groups are also present in these polymers or oligomers. These alcohol groups can be crosslinked with multifunctional isocyanates or melamine formaldehyde resins. Preferably different UV raw materials such as epoxy acrylates, polyether acrylates, polyester acrylates and in particular acrylate acrylates come into consideration as unsaturated oligomers or polymers. Both blocked and unblocked representatives based on TDI (TDI=toluene-2,4-diisocyanate), HDI (HDI=hexamethylene disocyanate) or IPDI (IPDI=Isophorone disocyanate) can come into consideration as isocyanate. The melamine crosslinkers can be fully etherified versions, can be imino types or can represent benzoguanamine representatives.

The protective layer preferably has a layer thickness of between 50 nm and 30 μm, preferably between 1 μm and 3 μm. The protective layer can be produced by means of gravure printing, flexographic printing, screen printing, inkjet printing, by means of a slot die and/or by means of vapor deposition, in particular by means of physical vapor deposition (PVD), chemical vapor deposition (CVD) and/or sputtering. The vapor deposition is effected in particular in the case of thinner protective layers under 1 μm.

The replication layer preferably has replication structures on one of its upper sides, at least in areas. Diffractively and/or refractively acting micro- and/or macrostructures are preferably molded into the replication layer. The replication layer is preferably formed of acrylate, cellulose, PMMA and/or crosslinked isocyanates and preferably has thermoplastic properties. A surface structure is molded into replication layers preferably by means of heat and pressure through the action of a stamping tool.

Furthermore, it is also possible for the replication layer to be formed by a UV-crosslinkable varnish and the surface structure is molded into the replication layer by means of UV replication. The surface structure is molded into the replication layer, which is not yet finally cured, by the action of a stamping tool and the replication layer is cured directly during or after the molding by irradiation with UV light. Before and/or during the molding, an additional irradiation with UV light can be effected.

In principle, the replication layer can be produced by means of the known printing methods. In particular, gravure printing, flexographic printing, screen printing or inkjet printing are suitable. However, production by means of a slot die is also possible.

The surface structure or replication structure molded into the replication layer is preferably a diffractive surface structure, for example a hologram, Kinegram® or another optically diffractive active grating structure. Such surface structures typically have a spacing of the structural elements in the range of from 0.1 μm to 10 μm, preferably in the range of from 0.5 μm to 4 μm. Furthermore, it is also possible for the surface structure to be a zero-order diffraction structure. This diffraction structure preferably has, in at least one direction, a period smaller than the wavelength of visible light, between the half wavelength of visible light and the wavelength of visible light, or smaller than the half wavelength of visible light. Furthermore, it is possible for the surface structure to be a blazed grating. Particularly preferably, it is an achromatic blazed grating in this case. Such gratings preferably have, in at least one direction, a period of between 1 μm and 100 μm, further preferably between 2 μm and 10 μm. However, it is also possible for the blazed grating to be a chromatic blazed grating. Furthermore, it is preferable that the surface structure is a linear or crossed sinusoidal diffraction grating, a linear or crossed single- or multi-step rectangular grating. The period of this grating preferably lies in the range between 0.1 μm and 10 μm, preferably in the range 0.5 μm to 4 μm. Further preferably, the surface structure is an asymmetrical relief structure, for example an asymmetrical saw-tooth structure. The period of this grating preferably lies in the range between 0.1 μm and 10 μm, preferably in the range 0.5 μm to 4 μm. Further preferably, the surface structure is a light-diffracting and/or light-refracting and/or light-focusing micro- or nanostructure, a binary or continuous Fresnel lens, a binary or continuous Fresnel freeform surface; a diffractive or refractive macrostructure, in particular a lens structure or microprism structure, a mirror surface or matte structure, in particular an anisotropic or isotropic matte structure, or a combination structure of several of the above-named surface structures.

The structure depth of the above-named surface structures or replication structures preferably lies in the range between 10 nm and 10 μm, further preferably between 100 nm and 2 μm.

The replication layer preferably has a layer thickness of between 200 nm and 5 μm. If the replication layer has a diffractive surface structure, then the layer thickness is preferably between 0.3 μm and 6 μm. If the replication layer has coarser structures, in particular with a greater period and/or greater depth, for example a so-called "surface relief", then the layer thickness is preferably approximately 1 μm to 10 μm. If the replication layer has a lens-shaped surface structure, then the layer thickness is preferably between 1.5 μm and 10 μm.

The replication or structuring of a surface of the replication layer can be effected in different ways. In the case of thermoplastic replication layers, a thermal replication is effected, in particular under the effect of heat and/or pressure. A print may already have been applied to the replication layer at this point in time. In this case, the print or the ink has substantially been applied to a smooth surface of the replication layer.

It is also conceivable that a UV replication is effected. If the print is formed with a UV-curable ink, the UV print can be advantageously protected with the UV-curing replication varnish. In particular reactive groups which "crosslink on" the UV-curable replication layer are located on the surface of the UV-curable ink.

In particular, in addition to the surface crosslinking, the through-cure of the UV-curable ink can also be improved through overmolding and/or encapsulation with the UV-curing replication varnish because, through the crosslinking in particular of thin UV-curable layers, disruptive inhibition effects, for example due to atmospheric oxygen, can be prevented. In particular, this can be particularly advantageous in the case of UV-curable inks applied thinner than approx. 1.5 μm as, with decreasing layer thickness of the UV-curable ink, inhibition effects have a stronger impact or can even prevent a surface and layer crosslinking to the extent that the print or the ink can remain sticky and e.g. a printed multilayer film cannot be wound up as a roll.

For curing thin UV-curing layers, as a rule complex and expensive inertization measures are necessary during the UV curing, in particular in the case of UV curing under protective gases such as argon or nitrogen. If the printing with the UV-curing ink is carried out without winding up the multilayer film in the same manufacturing step as the UV replication, these complex and expensive measures can be avoided by overlaying the UV-curable print with the UV-curing replication varnish downstream.

Moreover, the UV drying process used during the UV replication represents an additional post-curing for the UV print that is effective because of the minimization of the inhibition. In particular, after an optional pinning (UV precure), the UV-curing to equipment of the UV replication can also be used during application of the UV print, without an additional UV-curing equipment being necessary for curing the print itself.

In particular, combining the printing of the UV-curing ink with a UV-replication process directly downstream can lead to UV inks being able to be applied very much thinner than would be at all possible without complex measures determined by curing.

In particular, the "crosslinking-on" of the UV-curing ink or of the UV-curing print onto the surrounding matrix of the UV-replication varnish leads to the print being materially inseparably connected to the polymeric surroundings. The print then advantageously no longer represents a discrete layer on its own. This makes manipulation even more difficult.

In particular, it is advantageous if, through the UV curing of the UV-curing replication varnish, there is the possibility of post-crosslinking of the UV-curable ink which can lead to higher stabilities of the UV-curing ink.

It is furthermore advantageous for an application of UV replication to a print, in particular independently of the material composition of the print, that mechanical and/or thermal stresses on the print, in particular due to contact pressures or above all due to temperatures as occur during thermal replication, are significantly reduced.

During the UV replication, the structure-receiving replication layer is applied in particular as liquid. A printing can have been carried out before the application of the liquid replication layer or already be present on the previously applied layer of the multilayer body, onto which the liquid replication varnish is then applied.

However, the application of the ink or of the print can also be effected only after the structuring and optionally after the curing of the replication layer.

When the print is provided before the replication, the print is in principle located spatially in front of the layer with the replication structure, observed from the carrier side. In the case of a printing after the replication, the print is in principle located spatially behind the layer with a replication structure, observed from the carrier side. Both arrangements make different optical effects possible. For example, when observed from the carrier side, in the case of a printing after the structuring replication step, a diffractive structure can be superimposed on the print. This is not possible when observed from the carrier side if the printing has already been carried out before the structuring replication step.

In the case of applications in which the multilayer film is observed both from the carrier layer side and from the side facing away from the carrier side, in particular in a window or a transparent substrate area, the targeted positioning of the print or of the prints in front of, or observed from the carrier layer side, behind a replication layer, thus makes possible different visual effects on the observation side.

The positions of the replicated structures relative to the print can, in particular, also be realized in register with each other.

Preferably, the replication layer is provided with a reflective layer which can consist of a metal layer or a metallization and/or an HRI layer with a high refractive index (HRI).

The reflective layer can be opaque, semi-transparent or transparent, wherein the transparency can be, in particular, dependent on the observation angle.

The reflective layer can be applied both over the whole surface and in areas. The reflective layer is preferably formed patterned, in particular for the formation of motifs. The reflective layer can represent a pattern and/or a motif, which can also be arranged, in particular, in register with the print and/or with the structures of the replication layer.

The reflective layer is preferably a metal layer or a metallization. The metal layer or metallization is preferably formed of aluminum, chromium, gold, copper, tin, silver or an alloy of such metals. The metal layer or the metallization is preferably produced by means of vapor deposition, in particular by means of vacuum deposition. The vapor-deposited metal layer or metallization can be effected over the whole surface and either be retained over the whole surface or else structured with known demetallization methods such as etching, lift-off or photolithography and thus be only partially present. The layer thickness lies in particular between 10 nm and 500 nm.

However, the metal layer or the metallization can also consist of a printed layer, in particular of a printed layer of metal pigments in a binder. These printed metal pigments can be applied over the whole surface or partially and/or have different colorings in different surface areas. The layer thickness lies in particular between 1 μm and 3 μm.

It is also possible to produce the reflective layer from a varnish with electrically conductive metallic pigments, in particular to print and/or pour it on.

Furthermore, it is also possible for the reflective layer to be formed by a transparent reflective layer, for example a thin or finely-structured metallic layer or an HRI (high refractive index) or LRI (low refractive index) layer. Such a dielectric reflective layer consists, for example, of a vapor-deposited layer of a metal oxide, metal sulfide, titanium oxide etc. The layer thickness of such a layer is preferably 10 nm to 500 nm.

Furthermore, it is also possible for the reflective layer to be formed by at least one colored varnish layer wherein, in particular the refractive index $n_1$ of the at least one colored varnish layer and a refractive index $n_2$ of the replication layer are selected such that an amount of a difference between imaginary parts of the refractive indices $n_1$ and $n_2$ lies in the range of from 0.05 to 0.7, and wherein a lightness L* of the at least one colored varnish layer lies in the range of from 0 to 90, wherein the in particular diffractive relief structures in the replication layer produce a latent optically variable effect and the lightness L* has been measured according to the CIELAB L*a*b* formula under the following conditions: measurement geometry: diffuse/8° according to DIN 5033 and ISO 2496, diameter of measurement opening: 26 mm, spectral range: 360-700 nm according to DIN 6174, standard illuminant: D65. It has proved successful if the pigmentation of the at least one colored varnish layer is selected such that a pigmentation number PZ lies in the range of from 1.5 to 120 $cm^3/g$, in particular in the range of from 5 to 120 $cm^3/g$, wherein the pigmentation number PZ is calculated according to:

$$PZ = \sum_{1}^{x} \frac{(m_P \times f)_x}{(m_{BM} + m_A)} \text{ and } f = \frac{\ddot{O}Z}{d},$$

wherein:

$m_P$=mass of a pigment in the colored varnish layer in grams, $m_{BM}$=constant; mass of a binder in the colored varnish layer in grams, $m_A$=constant; solid-body mass of the additives in the colored varnish layer in grams, ÖZ=oil number of a pigment (according to DIN 53199), d=density of a pigment (according to DIN 53193), x=control variable corresponding to the number of different pigments in the colored varnish layer.

Furthermore, it is also possible to provide a first reflective layer in a semi-transparent embodiment as optical filter layer. Such a dielectric reflective layer consists, for example, of a vapor-deposited layer of thin metal (Al, Cr), or a thinly-applied metal oxide, metal sulfide, silicon oxide etc. The layer thickness of such a layer is selected such that the optical density lies in a range in particular of from 0.1 to 0.9 OD (OD=optical density). The subsequent dielectric spacer layer required for the thin-film effect can be coated analogously to the replication layer, wherein the layer thickness range preferably lies between 0.1 μm and 1.0 μm and/or the composition corresponds in particular to the replication layer. In this case, the spacer layer can also serve directly as a replication layer. The spacer layer can also be vapor-deposited as a ceramic spacer layer. Typically, metal or semi-metal oxides such as e.g. $SiO_2$, $TiO_2$, $Na_3AlF_6$ or $MgF_2$ are then vapor-deposited here according to one of the methods also named for the reflective layer. The layer thicknesses here lie in particular between 20 nm and 500 nm.

This optical filter layer can also already be applied before the replication layer. The replication layer then serves in particular as a dielectric spacer layer, wherein the layer thickness range preferably lies between 0.1 μm and 1.0 μm.

In connection with the dielectric spacer layer, an opaque or semi-transparent reflective layer is then vapor-deposited in particular as described above.

The adhesive layer or the primer layer is preferably formed of PMMA, PVC, acrylates, polyamide, polyvinyl acetates, hydrocarbon resins, polyesters, polyurethanes, chlorinated polyolefins, polypropylenes, epoxy resins and/or polyurethane polyols in particular in combination with inactivated isocyanates. The adhesive layer or the primer layer can moreover contain fillers, such as for example $SiO_2$ and/or $TiO_2$.

The layer thickness of the adhesive layer or the primer layer is preferably between 0.5 μm and 20 μm, particularly preferably between 1.5 μm and 5 μm. The adhesive layer or the primer layer can be produced by means of gravure printing, flexographic printing, screen printing, inkjet printing and/or by means of a slot die.

The ink can in principle be applied at least in areas to each layer of the multilayer film, in particular to the carrier layer, the detachment layer, the replication layer, the protective layer, the reflective layer and/or the adhesive layer and/or the primer layer.

The ink or the print serves in particular as a marking and/or as a register mark and/or for coloring. If, in particular after the curing and/or after drying, the ink exhibits poor adhesion to the layers adjoining it, then the ink or the print provided therewith can serve in particular as a predetermined breaking point within the multilayer film and/or cause partial release effects.

If required, that layer to which the ink is applied is preferably modified beforehand such that a sufficient adhesion or also a non-adhesion of the ink to this layer can be ensured. This can be guaranteed for example by corresponding surface additives in the varnish formulation or corresponding design of the layer, for example with crosslinkable UV-active groups on the surface. This is in particular advantageous if a UV-curing ink is used.

It is expedient if the ink is applied to several layers of the multilayer film. The inks applied to the layers can be formed both identical and also different. In particular the inks are applied in register with each other.

The print is preferably provided on several layers. In particular, the prints can be arranged in register with each other. If prints are provided on several layers of the multilayer film, then the individual prints can be formed different from each other. This is to be understood in particular to the effect that the prints differ from each other in their optical appearance. The prints can for example be formed by different inks and/or be formed as motifs differing from each other.

In a top view onto the multilayer film, the prints can be offset with respect to each other or also be arranged overlapping. In a top view onto the multilayer film, the prints can, however, also be arranged next to each other. Advantageously, the prints are arranged or formed on the layers such that, in a top view onto the multilayer film, at least some of the prints or parts of some of the prints form an overall motif. One or more of these prints can be individualized or also non-individualized. For example, one or more non-individualized prints can be complemented with one or more individualized prints to form an overall motif. This can be understood to the effect that a print displays, for example, a person's head and another print displays a person's body. In a top view onto the multilayer film, the head and the body are added together to form a person.

By register or registration, or register accuracy or registration accuracy, is meant a positional accuracy of two or more elements and/or layers relative to each other. The register accuracy is to range within a predetermined tolerance and be as low as possible. At the same time, the register accuracy of several elements and/or layers relative to each other is an important feature in order to increase the process reliability. The positionally accurate positioning can be effected in particular by means of sensorially, preferably optically detectable registration marks or register marks. These registration marks or register marks can either represent specific separate elements or areas or layers or themselves be part of the elements or areas or layers to be positioned.

Preferably the ink is applied to a carrier layer at least in areas. Thus a multilayer film is obtained in which at least one print is arranged on the carrier layer at least in areas.

In an embodiment variant, the ink applied to the carrier layer is preferably applied so thickly that the ink or the print has tactile and/or haptically perceptible properties. In this case the layer thickness range is in particular between 5 μm and 30 μm. A haptic surface which can also be individualized can in particular be created hereby. The ink printed on or the provided print in particular has a surface structure. In particular, the ink is applied or the print is provided such that they or it give(s) a certain structure or structuring to a layer, in particular a protective layer, optionally applied subsequently.

In a further embodiment, the ink can also be applied to the carrier layer in such a way that, following an application of the multilayer film to a substrate, and the subsequent removal of the carrier layer, the ink or the print remains at least partially, preferably completely on the carrier layer. It can hereby be documented e.g. subsequently, for example by reading the print remaining on the carrier layer, which label or which parts of the multilayer film have actually been applied. This can be effected, for example, by means of serial numbers, batch numbers or control numbers which are realized as numbers and/or encrypted codes, for example as barcodes.

Preferably, the ink is applied to a detachment layer at least in areas. Thus a multilayer film is obtained in which at least one print is arranged on the detachment layer at least in areas.

It is expedient if the ink is applied to a protective layer at least in areas. Preferably, the ink is applied in areas to a protective layer formed over the whole surface. Thus a multilayer film is obtained in which at least one print is arranged on the protective layer at least in areas. In particular, at least one print is arranged underneath the protective layer in the viewing direction and thus protected by the protective layer.

Furthermore, it is also possible for the ink to be applied, at least in areas, to a reflective layer, in particular to a metal layer and/or metallization and/or HRI layer. Thus a multilayer film is obtained in which at least one print is arranged on the reflective layer at least in areas.

If the ink is applied to a metal layer, the ink or the print can then serve in particular as an etch resist for a demetallization. If the ink is, for example, alkali-containing, a direct etching can also be produced through the application. If the ink or the print thus provided is formed as an etch resist, a demetallization can then take place in a subsequent step. The metal layer is preferably removed in those areas which are not covered by the print. If the print is individualized, an individualized demetallization can also be produced therewith.

Preferably, the ink is applied to an adhesive layer and/or to a primer layer at least in areas. Thus a multilayer film is obtained in which at least one print is arranged on the adhesive layer and/or on the primer layer at least in areas. Here, the ink is preferably formed such that the ink or the print itself can serve as a partial adhesive layer. E.g. an adhesive layer with an individualization is thus obtained. In the case of e.g. an actually transparent adhesive, a desired area can be designed e.g. colored by means of printing. In the case of applications in which the adhesive layer is visible, for example in a transparent area or in a window of a substrate or document, e.g. individualized items of information can thus be introduced into the adhesive layer.

However, it is also possible for the ink to be applied at least partially to the adhesive layer for the passivation, in particular for the partial passivation of the adhesive layer. In the case of a later application or hot-stamping, a transfer of the multilayer film to a substrate is then effected only in the areas of the adhesive layer not printed with ink. In particular, an individualized bonding is thus obtained. In the case of an application by means of hot-stamping, e.g. the need for special forming dies for personalized hot-stamping does not therefore apply, but rather this is achieved via an inkjet printing passivating the non-stamping areas.

Advantageously, the ink is applied to a replication layer at least in areas. A multilayer film is thus obtained, in which at least one print is arranged on the replication layer at least in areas.

The ink can be applied to a not-yet replicated replication layer. The replication layer or the replication varnish has in particular still-smooth surfaces. The replication is then effected in particular after the print has been provided. Structures can then be introduced into the print and/or into the replication layer through the replication. For example, a non-individualized item of information in the replication layer can be combined with an individualized print. A replication in the print can represent an additional protective measure against forgery because the print is thereby yet more integrated into the overall system of the multilayer film.

Ideally, the ink is applied to a substantially smooth surface of the replication layer, wherein the surface is preferably replicated at least in areas at a later point in time.

It is however also possible for the ink to be applied to an already-replicated replication layer, thus also to a replication layer which is already provided with a surface structure, a replication structure. The ink is preferably applied to the structured surface or to the replication structure at least in areas. In this case, e.g. a non-individualized item of information in the replication layer can also be combined with an individualized print.

If the ink is applied to an already-replicated replication layer or a print is provided, the application is preferably effected in register with the replication structure. Hereby, at least partial areas of the structures, in particular of the diffractive structures, can for example be filled in and in particular optically obliterated thereby. This is the case in particular when the ink has a refractive index similar to the replication layer, in particular with a refractive index with a difference of less than 0.2. This occurs in particular when the ink is applied with a layer thickness which is greater than the depth of the structures. However, it is also possible for the ink to be applied in a smaller layer thickness, in such a way that the ink follows the topology of the structures and thus in particular becomes part of the diffraction.

Furthermore, the ink can also be applied in such a way that the ink only partially fills the replication structures, in particular diffractive structures on the surface of the replication layer. A partial filling of the structures then occurs in particular when the finally-applied ink layer thickness is less than the depth of the replication structures.

Under specific conditions the ink can also fill in the structures without an obliteration being optically effected. This is in particular the case when the ink has reflective or highly refractive properties and differs in its complex refractive index in particular by more than 0.2 from the complex refractive index of the replication layer. An example of reflective inks are inks with metal effect pigments or metal flakes. An example of highly refractive inks are inks based on liquid crystals. For a partial filling, in particular macroscopic structures, i.e. in particular no longer diffractive effective structures, are also suitable in a replication layer.

An ink is preferably applied to the replication layer with a layer thickness which is greater than the depth of the structures to be introduced into the replication layer. In particular, the layer thickness of the applied ink is substantially twice as thick as the layer thickness of the structures to be introduced into the replication layer. A layer thickness of the ink that is at least twice as great as the depth of the structures to be introduced into the replication layer is in particular advantageous when a replication is only carried out after the application of the ink. It is thereby prevented that, during the replication, the structures introduced completely penetrate the applied ink.

In a further embodiment example, the ink is preferably printed on with a layer thickness smaller than the depth of the structures to be introduced into the replication layer. During the replication, the ink can thereby be penetrated with the structures introduced through the entire layer of the print, whereby the print through the continuous structures can receive a high-resolution fine structuring that is also visible from the carrier side, which exceeds the print resolution of inkjet printers and thus represents a further security feature.

It is also conceivable that at least one ink is applied to a not-yet-replicated replication layer and at least one ink is applied to a replicated replication layer. Thus at least one print is provided on a not-yet-replicated replication layer and at least one print is provided on an already-replicated replication layer. The same and also different inks can be used in this case. For example, one ink can provide a background color for the other ink, in particular in another color.

It is advantageous if the replication layer is replicated together with the print applied thereto. The print and the replication layer hereby each obtain a replication structure at least in areas. The replication structure in the print is then optically visible in the case of applications in a transparent area or in a window of a substrate or of a document when observed from the rear side and represents a further security feature. When observed in transmitted light, the structure thus introduced into the print can in particular represent a visually recognizable security feature due to the different thickness contrasts, which initially appears hidden to the observer and only becomes visible when observed in the transmitted light, in particular similar to a watermark.

The replication is preferably effected in register with the print. In particular, a tolerance of replication to print is achieved within +/−1.0 mm, preferably of +/−0.7 mm, particularly preferably of less than +/−0.4 mm.

It is expedient that the ink is applied in such a way that, during a subsequent replication, the replication structure introduced is impressed into the print, but not into the area of the replication layer covered by the print.

The print preferably has a thickness which is greater than the depth of the replication structure introduced into the print. In particular, the print has a layer thickness of between 0.5 μm and 10 μm.

The replication structure is advantageously introduced in such a way that an area of the replication layer which, in a top view onto the multilayer film, is arranged adjacent to the print is not replicated, in particular is not replicated due to the embossed nature of the print. In the following, this area is referred to as a corona. During a replication, the corona preferably does not come into contact with a replication tool. In a top view onto the multilayer film, the corona in particular directly adjoins the print. The area of the replication layer which is not replicated is dependent on the thickness of the ink application. For example, the corona substantially has a width of between 1 μm and 100 μm.

During the replication, the print is preferably pressed into the replication layer. In the case of a thermoplastic design, the replication layer is generally more easily deformable than the ink print. This applies in particular in the case of highly pigmented inks and crosslinked UV inks. This is substantially to be understood to the effect that, in particular those areas of the replication layer on which the print is arranged or located, lose layer thickness. In this case the thickness of the replication layer in the area of the print decreases, preferably over the entire area, homogeneously or uniformly. In the areas of the replication layer which, in a top view onto the multilayer film, are arranged adjacent to the print, i.e. adjoin the print, the layer thickness of the replication layer decreases less as the distance from the print increases, in particular during the replication.

The print is preferably compressed and/or deformed during the replication. It is hereby in particular possible for the print, as also the replication layer, to be replicated together at least in areas.

It is expedient, e.g. If required for reasons of improving adhesion, when an adhesion-promoter layer is applied to a layer of the multilayer film and/or underneath and/or to the ink or to the print at least in areas. The adhesion-promoter layer is preferably applied only in those areas to which the ink is then also applied later.

The adhesion-promoter layer ensures, in particular, that there is good adhesion between the layers connected thereto, with the result that a delamination can be prevented so far as possible. In particular, the adhesion-promoter layer prevents an unwanted predetermined breaking point from forming in the case of a cured print.

In particular PVC, mixtures of thermally and UV-curing acrylates, adhesion-promoter layers with adhesion-improving surface additives, such as for example functional acrylates, hydroxy-functional copolymers, block copolymers (from e.g. BYK or TEGO), plasma and/or corona treatments and/or also seeding by metal vapor deposition are conceivable as adhesion-promoter layer.

The adhesion-promoter layer can preferably be produced by means of gravure printing, flexographic printing, inkjet printing, screen printing, slot die and/or spray varnishing. The adhesion-promoter layer preferably has a layer thickness of between 0.1 μm and 1.5 μm during printing. If the adhesion-promoter layer is produced by means of vapor deposition, then the layer thickness is preferably between 1 nm and 50 nm.

If the ink is applied to a not-yet replicated replication layer, then an adhesion-promoter layer can often be dispensed with. Experience has shown that the replication of the replication layer together with the print brings about an improved adhesion of the print on the replication layer. Moreover, replication together also brings about a surface roughening of the print, whereby subsequent layers also adhere well to the print.

In a further embodiment example, an anti-adhesion layer can preferably be applied, at least in areas, to a layer of the multilayer film and/or to the ink or to the print.

The anti-adhesion layer is preferably formed of silicon acrylates, fluorinated polymers and/or waxes.

It is advantageous if the ink is applied to a layer of the multilayer film, in particular to the carrier layer, the detachment layer, the replication layer, the reflective layer, the adhesive layer and/or the protective layer, with the interposition of at least one adhesion-promoter layer and/or anti-adhesion layer.

In a further embodiment example, an ink is preferably provided, which comprises laser-sensitive pigments. The pigments can be, for example, ammonium octamolybdates (AOM). The laser-sensitive pigments offer the advantage that an in particular further individualization of the multilayer film and/or of the print is hereby made possible downstream of the printing. The ink comprising the laser-sensitive pigments can be formed transparent or translucent or also colored at least in areas.

If the laser-sensitive pigments or the ink comprising the laser-sensitive pigments are exposed for example to laser radiation, then the optical appearance of the pigments in particular changes. The pigments undergo in particular a color change or a blackening.

Another type of laser-sensitive pigments is based in particular on modified mica. These modified micas are strongly heated by laser irradiation and thus burn the surrounding polymers to form carbon black. This can likewise lead to blackening.

Advantageously, the ink or the print is irradiated at least in areas by means of a radiation source, in particular by means of a laser. The optical appearance of the print is hereby changed. In particular, an ink or a print comprising laser-sensitive pigments and/or organic dyes is irradiated with a radiation source.

A color change and/or a blackening and/or a bleaching-out at least of parts of the print can result through the irradiation, in particular through the irradiation by means of a laser beam. Moreover, previously invisible and/or transparent parts or areas of the print can preferably be made partially or completely visible through the irradiation. A partial, as well as a complete blackening of at least parts of the print which can be formed both invisible and colored before the irradiation, is also possible. Colored or visible areas of the print can also bleach out and in particular lead to visible contrast differences in particular when, instead of color pigments, less light-resistant organic dyes at least partially form the chromaticity of the print. In particular a further or complementary individualization of the print or a personalization of the print or of the multilayer film can thus be achieved through the irradiation.

The complementary individualization can be effected both during the manufacture of the multilayer film and after manufacture of the film, in particular after the application of the film to a substrate, in particular to a security document.

It is also conceivable for the print to be irradiated several times, whereby in particular a first complementary individualization or personalization and at least one further complementary individualization or personalization is created. The irradiations are preferably effected at different points of the print. However, it is also possible for the irradiations or the irradiation areas to overlap.

The several irradiations can all be effected during the manufacture of the multilayer film or else partially during the manufacture and partially after the manufacture, in particular after an application of the multilayer film to a substrate, or else all be effected after the manufacture. It is advantageous if the first complementary individualization is effected during the manufacture of the multilayer film and at least one further individualization is effected after the manufacture of the film, in particular after the application of the film to a substrate.

Several possibilities are conceivable for the production of the further or complementary individualization. One possibility consists, for example, in the application of an invisible ink. The ink can be applied either over the whole surface or in areas, in particular as a motif. The irradiation of the ink in areas or also completely is then effected subsequently. Thus either only areas of the ink or else the entire surface printed with ink are hereby made visible. It is advantageous if only areas of the applied ink are irradiated.

Furthermore, it is possible for at least one ink, in particular an invisible or transparent ink to be applied adjacent, preferably directly adjoining, to a visible marking, in particular to a visible partial marking. The marking or partial marking can be an ink or an area of a print within the meaning of the invention. It is however also possible for the visible marking or partial marking to be a coding, a decoration, a decorative design and/or a motif, which can be arranged on any one of the layers of the multilayer film. The coding, the decorative design and/or the motif can have been created or produced in a not specifically stipulated manner. The at least one ink is now preferably irradiated such that the irradiated surface of the at least one ink forms an overall marking with the visible marking or partial marking. It is conceivable here that the visible marking or partial marking represents part of a coding, part of a shape, in particular of a geometrical shape, or of a motif and the shape or the motif is completed by the irradiated ink through the irradiation at least of areas of the at least one ink.

It is also possible to apply the ink as a visible and/or colored surface and/or structure and/or motif and then to blacken by irradiating in areas or completely with a laser.

In a further embodiment example, a print is preferably provided, which is formed as a wash varnish.

Lift-off methods are known from the state of the art. They serve in particular for producing metallic microstructures. In the lift-off method, in particular a wash varnish is applied in the form of a desired design and then overlaid or covered with at least one further layer, in particular a metallization or a further varnish. The wash varnish can then be removed again by means of a solvent treatment, together with parts of the further layer or the further layers, with the result that the further layer or the further layers remain only where no wash varnish was applied beforehand.

In order to provide a print as a wash varnish, in particular an ink is provided which comprises polyvinylpyrrolidones and/or methyl cellulose.

In this case the resolution of the ink lies in particular substantially in the range of the DPI resolution of the inkjet (see following table). Because of a certain swelling of the print during the solvent treatment, there may be an increase in surface area. The dot gain should not be more than approximately 10%, in order not to cause a significant deterioration in the resolution of the print.

| DPI | Dot size (μm) |
|---|---|
| 300 | 84.7 μm × 84.7 μm |
| 360 | 70.6 μm × 70.6 μm |
| 600 | 42.3 μm × 42.3 μm |
| 900 | 28.2 μm × 28.2 μm |
| 1200 | 21.2 μm × 21.2 μm |

Water, ethanol and/or isopropanol can be used as solvents.

After the provision of a print which is formed as a wash varnish, a metal layer and/or a metallization is preferably applied over the whole surface. The wash varnish is then removed again together with parts of the metal layer and/or the metallization in particular by a solvent treatment, with the result that the metal layer and/or the metallization remains only where no ink has been applied or no print has been provided beforehand.

In a further embodiment example, a layer with interference pigments and/or at least one volume hologram can be applied at least in areas. Preferably in addition, at least one light-absorbing, preferably an opaque, particularly preferably a black print is provided at least in areas.

Interference pigments are generally known, and have an optically variable color change effect in the case of a changing observation and/or illumination angle. The pigments are often transparent or translucent and because of this, can only be seen with difficulty on light backgrounds, or not at all, and also the color change effect is then correspondingly weak. Volume holograms are generally known, and have an optically variable effect in the case of a changing observation and/or illumination angle. Volume holograms are often transparent or translucent and because of this, can only be seen with difficulty on light backgrounds, or not at all, and also the optically variable effect is then correspondingly weak. The print formed light-absorbing or opaque ensures in particular that the interference pigments and/or the volume holograms stand out better or become visible in the area of the print. The print is preferably formed substantially black.

The layer with interference pigments is preferably applied over the whole surface or in the form of patches, in the form of strips or as an extensive overlay film. Volume holograms are preferably applied in the form of patches or in the form of strips or in the form of an extensive overlay film. It is advantageous that the print, in particular the light-absorbing and/or opaque and/or black print is now formed only partial or in areas. This creates the optical impression that the interference pigments and/or the volume hologram are applied only locally, namely in that area which is provided by the print, because the optical effects stand out above all in the area which is provided by the print.

It is advantageous if the print is formed as a code, in particular as a QR code or as a micro QR code or as a barcode or as a data matrix code. The QR codes or the micro QR codes are preferably composed of a plurality of code elements. The micro OR codes can be formed e.g. from 11×11, 13×13, 15×15 or 17×17 code elements. The QR codes can be formed e.g. from 22×22 or 32×32 code elements.

It is advantageous if the individual code elements are composed of a plurality of ink droplets. In particular, observed in one direction, in particular in the X direction, at least 2, preferably 4 ink droplets are printed in order to provide a code element. In particular 2×2, preferably 4×4 ink droplets are thus printed or required for a code element in the case of two-dimensional observation. The more ink droplets, the better and the cleaner the edges of the code element and thus also of the code appear.

The QR codes or the micro OR codes in each case preferably both have a size of approximately 5×5 mm, preferably 3×3 mm.

The items of information relating to the print are preferably stored in a database, and the application of the print is effected in particular on the basis of the stored items of information.

For the application of the ink in the digital print, an inkjet printhead with a resolution of from 300 to 1200 npi (nozzles per inch) is preferably used. A high-resolution application of the ink is hereby made possible, with the result that fine motif structures can also be printed with sharp edges. As a rule, the resolution of the printhead corresponds to the achieved resolution of the adhesive droplets on the layer in dpi (dots per inch).

It is further preferred if, for the application of the ink, an inkjet printhead with a nozzle diameter of from 15 μm to 25 μm with a tolerance of not more than ±5 μm and/or a nozzle spacing of from 30 μm to 150 μm in particular, or a nozzle spacing of from 30 μm to 80 μm, with a tolerance of not more than ±5 μm, is used.

Through the small nozzle spacing—in particular transverse to the printing direction—it is ensured that the transferred inks lie sufficiently close to each other on the layer, or optionally also overlap, with the result that a good adhesion is achieved over the entire printed surface.

It is further preferred if the ink is applied with a weight per unit area of from 0.5 g/m$^2$ to 30 g/m$^2$ and/or a layer thickness of from 0.2 μm to 30 μm, preferably of from 0.5 μm to 15 μm, on the at least one partial area. Within this area, which guarantees a good adhesion, the application quantity or layer thickness of the ink can be varied depending on the layer used, in particular on its absorbency, in order to further optimize the application result.

It is expedient if, through the inkjet printhead, adhesive droplets are provided at a frequency of from 6 kHz to 110 kHz. In the case of usual conveying speeds of from 10 m/min to 30 m/min of the film to be printed, the desired resolution of from 360 dpi to 1200 dpi can thus be achieved.

Ink droplets with a volume of from 2 pl to 50 pl with a tolerance of not more than ±6% are preferably provided through the inkjet printhead. Thus, in the case of the application resolutions and application speeds described, the necessary ink quantity is applied evenly to the layer.

It is preferred if ink droplets are provided through the inkjet printhead with an airspeed of from 5 m/s to 10 m/s with a tolerance of not more than +15%. The deflection of the ink droplets in particular by drafts during the transfer from the printhead to the layer is hereby minimized, with the result that the ink droplets land on the layer in the desired defined arrangement.

Ink droplets with a width or an extent of between 10 μm and 100 μm, preferably between 20 μm and 90 μm, particularly preferably between 21.2 μm and 84.7 μm are preferably applied.

It is expedient if the ink is applied to the layer with an application temperature of from 30° C. to 45° C., preferably from 40° C. to 45° C. and/or a viscosity of from 7 mPas to 30 mPas, preferably of from 5 mPas to 20 mPas. The temperature control of the printhead ensures that the ink has the desired viscosity. The pixel size and pixel shape of the ink applied to the layer in turn depends on the viscosity, wherein an optimum printability of the ink is guaranteed in the case of the specified values. For this purpose, the printhead can be formed temperature-controllable, in particular heatable and/or coolable.

As soon as the ink leaves the printhead and comes into contact with ambient air or the layer, cooling occurs, whereby the viscosity of the ink is increased. This counteracts running or spreading of the transferred ink droplets.

It is further advantageous if, during the application of the ink, a distance between inkjet printhead and layer does not exceed 1 mm. The influencing of the ink by drafts is also reduced hereby.

During the application of the ink, a relative speed between inkjet printhead and layer is preferably 10 m/min to 100 m/min, in particular approximately 10 m/min to 75 m/min. At these speeds, in particular in combination with the parameters specified above, the desired resolution of the ink printed on the layer is achieved.

An example of the composition of a black-colored UV-curing ink is given below (percentages mean percent by volume):

| | |
|---|---|
| 2-phenoxyethyl acrylate | 10% to 60%, preferably 25% to 50%; |
| 4-(1-oxo-2-propenyl)-morpholine | 5% to 40%, preferably 10% to 25%; |
| exo-1,7,7-trimethylbicyclo[2.2.1]-hept-2-yl acrylate | 10% to 40%, preferably 20% to 25%; |
| 2,4,6-trimethylbenzoyldiphenyl-phosphine oxide | 5% to 35%, preferably 10% to 25%; |
| dipropylene glycol diacrylate | 1% to 20%, preferably 3% to 10%; |
| urethane acrylate oligomer | 1% to 20%, preferably 1% to 10%; |
| carbon black pigment | 0.01% to 10%, preferably 2.5 to 5.0%. |

An example of the composition of a thermally drying cyan-colored ink is given below (percentages mean percent by volume):

| | |
|---|---|
| 2-pyrrolidone | 5% to 15%, preferably 7% to 10%; |
| 1,5-pentanediol | 6% to 10%, preferably 8% to 9%; |
| 2-pyrrolidone | 5% to 15%, preferably 7% to 10%; |
| 2-ethyl-2-hydroxymethyl-1,3-propanediol | 5% to 15%, preferably 7% to 10%; |
| dye (for cyan e.g. DB 199) | 5% to 10%, preferably 7% to 10%; |
| water | 30% to 80%, preferably 60%-70%. |

An example of the composition of a thermally drying pigment-containing ink is given below (percentages mean percent by volume):

| | |
|---|---|
| N-methyl-N-oleyltaurate | 0.5% to 2%, preferably 1% to 1.5%; |
| diethylene glycol | 5% to 10%, preferably 7% to 8%; |
| glycerol | 10% to 15%, preferably 11% to 13%; |
| pigment | 1% to 5%, preferably 2% to 3%; |
| water | 20% to 80%, preferably 60% to 75%. |

Such formulations yield in particular the desired properties, in particular the quick curing and/or drying and a viscosity which makes possible a good printability with a simultaneously stable and sharp application.

A light-curing, in particular UV-curing ink is preferably printed on.

In the present case, by light is meant in particular not only the part of the electromagnetic radiation visible to the human eye, but in particular also the ranges adjoining the visible light, in particular infrared and/or ultraviolet radiation. Substantially the physical definition of light applies, namely that light covers the entire electromagnetic spectrum.

The ink can be partially cured, or pre-cured and/or cured by radiation, preferably by UV radiation, in particular by UV LED radiation. Such inks are referred to as UV inks below.

For UV inks it is expedient if the ink with a density of from 1 g/ml to 1.5 g/ml, preferably from 1.0 g/ml to 1.1 g/ml is used.

It is advantageous for the UV inks to be pre-cured. The pre-curing of the ink is preferably effected 0.02 s to 0.025 s after the application of the ink. After the printing, the ink is hereby fixed very quickly on the layer through the curing, with the result that running or spreading of the ink droplets is largely avoided and the high print resolution remains as well-preserved as possible. However, there may also be applications where a UV pre-curing is not required because of the properties of the layer. This is not necessary when the ink droplets applied do not run or spread on the layer, even without pre-curing.

In the case of pre-curing it is expedient if the pre-curing of the UV ink is effected with UV light, the energy of which is emitted at least 90% in the wavelength range between 380 nm and 420 nm. In particular in the case of the UV ink formulations described above, radical curing is reliably initiated at these wavelengths.

It is further advantageous if the pre-curing of the UV ink is effected with a gross irradiance of from 2 W/cm$^2$ to 5 W/cm$^2$ and/or a net irradiance of from 0.7 W/cm$^2$ to 2 W/cm$^2$ and/or an input of energy in the ink of from 8 mJ/cm$^2$ to 112 mJ/cm$^2$. It is hereby achieved in particular, that the ink undergoes the desired increase in viscosity, with the result that when the UV ink is applied to the layer, running or spreading of the UV ink is largely minimized in the time up to passage through the UV-curing station for complete curing.

The pre-curing of the UV ink is preferably effected with an exposure time of from 0.02 s to 0.056 s. At the mentioned transport speeds of the layer and the specified irradiances, the necessary input of energy for the pre-curing is thus ensured.

It is expedient if, when the UV ink is pre-cured, its viscosity is increased to 50 mPas to 200 mPas. Such an increase in viscosity guarantees that the UV ink does not spread or run on the layer and the digital print can be substantially transferred to the layer with the resolution achieved when printing the UV ink.

The curing, in particular the complete curing, of the ink is effected in particular 0.2 s to 1.7 s after application to the layer. The curing is preferably effected in a UV-curing station which is generally arranged downstream for reasons of space.

It is expedient if the curing of the UV ink is effected with UV light, the energy of which is emitted at least 90% in the wavelength range between 380 nm and 420 nm. In particular in the case of the UV ink formulations described above, radical curing is reliably initiated at these wavelengths.

Furthermore, it is preferred if the curing of the UV ink is effected with a gross irradiance of from 12 W/cm$^2$ to 20 W/cm$^2$ and/or a net irradiance of from 4.8 W/cm$^2$ to 8 W/cm$^2$ and/or an input of energy into the adhesive of from 200 mJ/cm$^2$ to 900 mJ/cm$^2$, preferably from 200 mJ/cm$^2$ to 400 mJ/cm$^2$. In the case of such an input of energy, a reliable through-curing of the ink is achieved, with the result that after the curing step, the digital print is no longer sticky and the printed layer or film can in principle be rolled up.

Furthermore, it is advantageous if the curing of the UV ink is effected with an exposure time of from 0.04 s to 0.112 s. In the case of the specified gross irradiances and the usual transport speeds, the necessary net energy input for the through-cure of the UV ink is thus ensured.

However, it is also possible to use inks which dry by themselves and/or are dried after the application or after the printing. In particular, inks with solvent and/or water are suitable for this. Thermally drying inks are preferably used. Parts of the solvent and/or of the water may already evaporate during the flight phase of the ink droplets. At least one further part can then be evaporated with the aid of additives.

The inks can be dried in particular by means of radiation, in particular by means of IR radiation (IR=infrared). The use of convection dryers is also conceivable. The duration of the drying is preferably between 1 s and 60 s and/or the temperature lies between 40° C. and 120° C.

The print is preferably arranged on a replication layer. In particular the print is replicated at least in areas. This means that the print has a replication structure at least in areas. It is advantageous if the replication structure is arranged in register with the print in particular, the replication to print tolerance lies within +/−1.0 mm, preferably within +/−0.7 mm, particularly preferably less than +/−0.4 mm.

It is advantageous if, in a top view onto the multilayer film, at least one area of the replication layer which is adjacent to, in particular directly adjoins the print, is not replicated. This means in particular that this area has no replication structure. The surface of the area is preferably smooth. This area in particular ensures a contrast-enhancing with respect to the print. The width of this area without structure transfer depends in particular on the type of the replication tool, in particular whether this is formed rigid or flexible, the application thickness of the print and/or the layout of the print, i.e. for example the distance of the printed areas of the print from each other. For example, the corona has substantially a width of between 1 μm and 100 μm. In particular, in the case of less flexible replication tools, the embossed nature of the print can prevent complete contact between the structuring and the entire surface of the replication layer.

The applied ink or the print preferably only partially fills the replication structures, in particular diffractive structures of the replication layer. However, it is also possible that, in the areas where the ink or the print is present, these completely fill the replication structures. Furthermore, it is also conceivable that the ink or the print follow the topography of the replication structures.

The multilayer film can have an adhesion-promoter layer at least in areas, wherein the adhesion-promoter layer is preferably applied only in those areas where the print is also arranged. The print preferably directly adjoins the adhesion-promoter layer.

Furthermore, the multilayer film can have an anti-adhesion layer, at least in areas. The anti-adhesion layer is preferably arranged on the print.

The ink or the print preferably comprises laser-sensitive pigments.

It is expedient if the print is formed of a single ink and has at least a first area and a second area, wherein the areas differ from each other in their optical appearance. One area can be formed transparent or invisible and the other area can be formed to opaque and/or colored. It is also conceivable that one of the areas has a black coloration.

In particular, the print has visible and invisible areas. It is advantageous here if it is a print with laser-sensitive pigments.

The multilayer film can, at least in areas, preferably over the whole surface, have a layer with interference pigments and/or at least one volume hologram. The print is preferably formed light-absorbing, in particular opaque, particularly preferably black.

Through the print, the interference pigments or the volume hologram stand out particularly strongly and are thus well visible to the observer. In particular, through a print applied in a partially targeted manner, color impressions dependent on the observation and/or illumination angle can also be produced only in individual surface areas of the interference pigments and/or volume holograms.

The print is preferably arranged only in areas on the volume hologram and/or on the layer comprising interference pigments. This creates the impression that the volume hologram and/or the interference pigments are only applied in areas. Ideally, the layer comprising interference pigments is formed over the whole surface, or the volume hologram is formed as a patch or strips or as an extensive overlay film.

The print need not necessarily be arranged directly adjoining the layer comprising interference pigments or on the volume hologram. It is perfectly possible for yet further layers to be arranged between the print and the layer comprising interference pigments and/or the volume hologram.

It is advantageous if the print is formed as a code, in particular as a QR code or as a micro QR code or as a barcode or as a data matrix code.

It is expedient if prints are applied to each of several layers of the multilayer film. The prints applied to the respective layers can preferably differ from each other. In particular, in a top view onto the multilayer film, the prints are arranged in register with each other and/or overlapping and/or next to each other.

BRIEF DESCRIPTION OF THE DRAWINGS

In the following the invention is explained with reference to several embodiment examples utilizing the attached drawings by way of example. There are shown in.

DETAILED DESCRIPTION OF THE PREFERRED EMBODIMENTS

Figure 1:
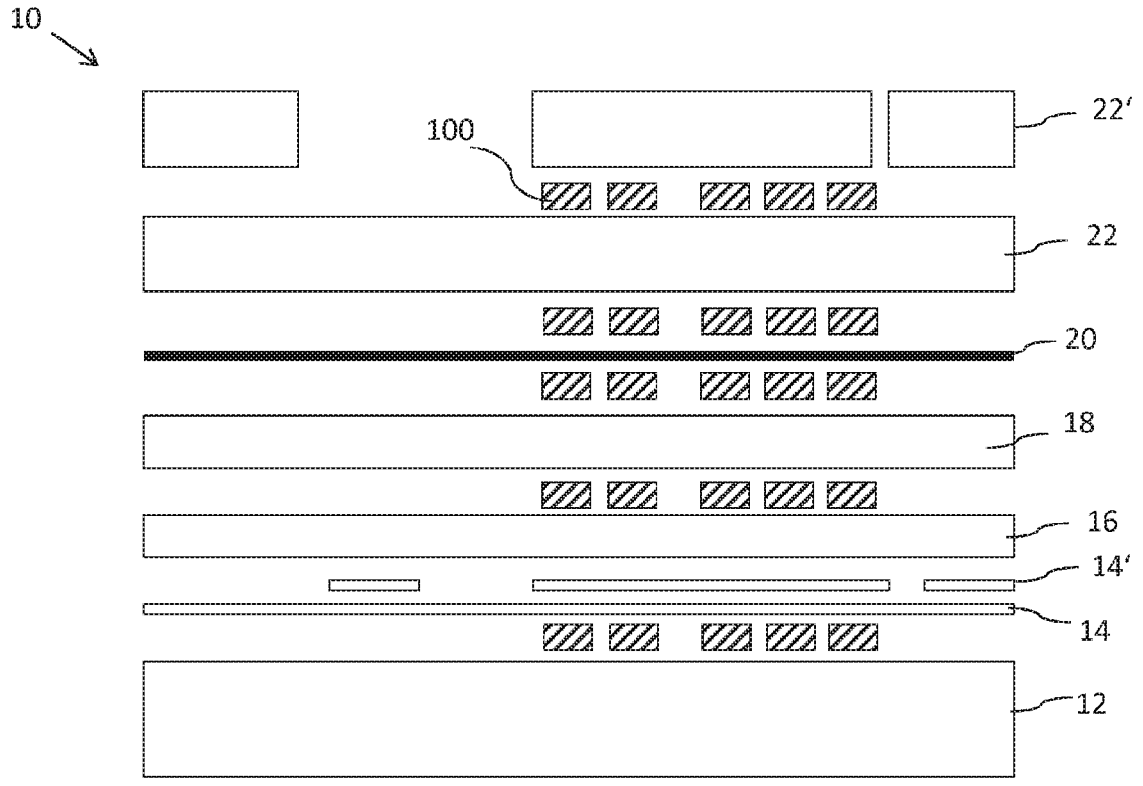
FIG. 1 schematic representation of possible arrangements of a print in a multilayer film FIG. 2 schematic process of the formation of replication structures FIG. 3 schematic process of the production of a multilayer film in one embodiment FIG. 4 schematic representation of a multilayer film in an embodiment before and after laser irradiation FIG. 5 schematic representation of a multilayer film in a further embodiment before and after laser irradiation FIG. 6 schematic representation of a multilayer film in a further embodiment before and after laser irradiation FIG. 7 schematic top view onto a print in one embodiment FIG. 8*a* to 8*d* schematic top view onto a print in further embodiments FIG. 9*a*, 9*b* schematic top view onto a print in further embodiments FIG. 10*a*, 10*b* microscope images of an area of a print in one embodiment.

FIG. 1 shows a schematic representation of possible arrangements at least of one print 100 in a multilayer film 10.

The ink can in principle be applied to each layer of the multilayer film 10, at least in areas, with the result that the print 100 can in principle be provided or arranged on each layer of the multilayer film 10. In particular, the print 100 is arranged on the carrier layer 12, the detachment layer 14, the replication layer 18, the protective layer 16, the reflective layer 20 and/or the adhesive layer 22. The print 100 can be an individualized print or also a non-individualized print.

If required, the layer to which the ink is applied is preferably modified beforehand such that a sufficient adhesion or also a non-adhesion of the ink or the print 100 to this layer can be ensured. This can be guaranteed for example by corresponding surface additives in the varnish formulation or corresponding design of the layer, for example with cross-linkable UV-active groups on the surface. This is in particular advantageous if a UV-curing ink is used.

It is expedient if the ink is applied to several layers of the multilayer film. The inks applied to the layers can be formed both identical and also different. In particular, the inks are applied in register with each other. A multilayer film 10 is hereby obtained, in which at least one first print 100 is formed on several layers. In particular, the prints 100 can be arranged in register with each other.

If several prints 100 are provided on several layers of the multilayer film 10, the individual prints 100 can be formed different from each other. This is to be understood in particular to the effect that the prints 100 differ from each other in their optical appearance. The prints 100 can for example be formed by different inks and/or be formed as motifs differing from each other.

Furthermore, in a top view onto the multilayer film 10, the prints 100 can be offset with respect to each other or also be arranged overlapping. In a top view onto the multilayer film 10, the prints 100 can, however, also be arranged next to each other. Advantageously, the prints 100 are arranged or formed on the layers such that, in a top view onto the multilayer film, at least some of the prints 100 or parts of some of the prints 100 together form an overall motif.

Preferably the ink is applied to a carrier layer 12 at least in areas. Thus a multilayer film 10 is obtained, in which at least one print 100 is arranged on the carrier layer 12 at least in areas.

The ink applied to the carrier layer 12 is preferably applied such that the ink or the print 100 has tactile and/or haptically perceptible properties. An individualized haptic surface can in particular be created hereby, when the print 100 is individualized. The ink printed on or the print 100 provided in particular has a surface structure. In particular, the ink is applied or the print is provided in such a way that they or it give(s) a certain structure or structuring to a layer, in particular a protective layer 16, optionally applied subsequently.

The ink can further be applied to the carrier layer 12 in such a way that, following an application of the multilayer film 10 to a substrate, and the subsequent removal of the carrier layer 12, the ink or the print 100 remains at least partially, preferably completely on the carrier layer 12. It can hereby be documented e.g. subsequently, for example by reading the print 100 remaining on the carrier layer 12, which parts of the multilayer film 10 have actually been applied.

The carrier layer 12 consists in particular of a material that is self-supporting and/or from the plastics class of substances. The carrier layer 12 is preferably formed of PET, of a polyolefin, in particular of OPP, BOPP, MOPP, PP and/or PE, of PMMA, of PEN, of PA, of ABS and/or a composite material of these plastics. It is also possible for the carrier layer 12 to have already been pre-coated by the manufacturer and the multilayer film 10 is built up on this pre-coated material. It is also possible for the carrier layer 12 to be a bio-degradable and/or compostable carrier layer 12. EVOH is preferably used in this case. The layer thickness of the carrier layer 12 advantageously lies between 4 μm and 500 μm, in particular between 4.7 μm and 250 μm.

The multilayer film 10 can be formed as a laminating film which has a carrier layer 12 and a multilayer wear layer, for example a multilayer decorative ply, as well as an in particular heat-activatable adhesive layer, wherein carrier layer 12 and wear layer are arranged together in the form of a stamping layer on the substrate.

In particular, the multilayer film 10 is formed as a transfer film. A transfer film comprises in particular a transfer ply, which is preferably formed of several layers, in particular comprises at least one adhesive layer 22, one reflective layer 20, one replication layer 18 and/or one protective layer 16, and a carrier layer 12, wherein the transfer ply is detachable from the carrier layer 12. To facilitate the detachment of the transfer ply, a detachment layer 14 can be arranged between the transfer ply and the carrier layer 12.

Preferably, the ink is applied to a detachment layer 14 at least in areas. Thus a multilayer film 10 is obtained, in which at least one print is arranged on the detachment layer 14 at least in areas. The detachment layer can be present both partially 14' and over the whole surface 14.

The detachment layer 14 ensures in particular that the layers of the multilayer film 10 can be separated from the carrier layer 12 non-destructively. The detachment layer 14 is preferably formed of waxes, polyethylene (PE), polypropylene (PP), cellulose derivatives and/or poly(organo)siloxanes. Above-named waxes can be natural waxes, synthetic waxes or combinations thereof. Above-named waxes are, for example, camauba waxes. Above-named cellulose derivatives are, for example, cellulose acetate (CA), cellulose nitrate (CN), cellulose acetate butyrate (CAB) or mixtures thereof. Above-named poly(organo)siloxanes are, for example, silicone binders, polysiloxane binders or mixtures thereof. The detachment layer 14 preferably has a layer thickness of between 1 nm and 500 nm, in particular a layer thickness of between 5 nm and 250 nm, in particular preferably between 10 nm and 250 nm.

The detachment layer 14 can be produced with the known printing methods. In particular, gravure printing, flexographic printing, screen printing, inkjet printing or by means of a slot die are suitable. The detachment layer 14 can however also be formed by vapor deposition, physical vapor deposition (PVD), chemical vapor deposition (CVD) and/or sputtering.

It is expedient if the ink is applied to a protective layer 16 at least in areas. Preferably the ink is applied in areas to a protective layer 16 formed over the whole surface. Thus a multilayer film 10 is obtained in which a print 100 is arranged on the protective layer 16 at least in areas. In particular, the print 100 is arranged, in the viewing direction, underneath the protective layer 16 and thus also protected by the protective layer 16.

The protective layer 16 is preferably a layer of PMMA, PVC, melamines and/or acrylates. The protective varnish can also consist of a radiation-curing dual-cure varnish. This dual-cure varnish can be thermally pre-crosslinked in a first step during and/or after application in liquid form. Preferably, in a second step, in particular after the processing of the multilayer film, the dual-cure varnish is radically post-crosslinked, in particular via high-energy radiation, preferably UV radiation. Dual-cure varnishes of this type can consist of different polymers or oligomers, which have unsaturated acrylate or methacrylate groups. These functional groups can, in particular in the second step, be radically crosslinked with each other. For the thermal pre-crosslinking in the first step it is advantageous that at least two or more alcohol groups are also present in these polymers or oligomers. These alcohol groups can be crosslinked with multifunctional isocyanates or melamine formaldehyde resins. Different UV raw materials such as epoxy acrylates, polyether acrylates, polyester acrylates and in particular acrylate acrylates preferably come into consideration as unsaturated oligomers or polymers. Both blocked and unblocked representatives based on TDI (TDI=toluene-2,4-diisocyanate), HDI (HDI=hexamethylene diisocyanate) or IPDI (IPDI=isophorone diisocyanate) can come into consideration as isocyanate. The melamine crosslinkers can be fully etherified versions, can be imino types or represent benzoguanamine representatives.

The protective layer 16 preferably has a layer thickness of between 50 nm and 30 μm, preferably 1 μm to 5 μm. The protective layer 16 can be produced by means of gravure printing, flexographic printing, screen printing, inkjet printing, or by means of a slot die and/or by means of vapor deposition, in particular by means of physical vapor deposition (PVD), chemical vapor deposition (CVD) and/or sputtering.

Furthermore, it is also possible for the ink to be applied, at least in areas, to a reflective layer 20, in particular to a metal layer and/or metallization and/or HRI layer. Thus a multilayer film 10 is obtained in which at least one print 100 is arranged on the reflective layer 20 at least in areas.

If the ink is applied to a metal layer, the ink or the print 100 can then serve in particular as an etch resist for a demetallization. If the ink or the thus-provided print 100 is formed as an etch resist, a demetallization can then take place in a following step. The metal layer is preferably removed in those areas which are not covered by the print 100. If the ink is alkali-containing for example, a direct etching can also be produced through the application. If the print 100 is individualized, an individualized demetallization can also be produced therewith.

The reflective layer 20 can be applied both over the whole surface and in areas. The reflective layer 20 is preferably formed patterned, in particular for the formation of motifs. The reflective layer 20 can represent a pattern and/or a motif, which can also be arranged, in particular, in register with the print 100 on other layers of the multilayer film 10 and/or with the structures of the replication layer 18.

The reflective layer 20 is preferably a metal layer or a metallization. The metal layer or metallization is preferably formed of aluminum, chromium, gold, copper, tin, silver or an alloy of such metals.

The metal layer or the metallization is preferably produced by means of vapor deposition, in particular by means of vacuum vapor deposition. The vapor-deposited to metal layer or metallization can be effected over the whole surface and either retained over the whole surface or else be structured with known demetallization methods such as etching, lift-off or photolithography and thereby be only partially present. The layer thickness lies in particular between 10 nm and 500 nm.

However, the metal layer or the metallization can also consist of a printed layer, in particular made of a printed layer of metal pigments in a binder. These printed metal pigments can be applied over the whole surface or partially and/or have different colorings in different surface areas. The layer thickness lies in particular between 1 μm and 3 μm.

It is also possible to produce the reflective layer 20 from a varnish with electrically conductive metallic pigments, in particular to print and/or pour it on.

Furthermore, it is also possible for the reflective layer 20 to be formed by a transparent reflective layer 20, for example a thin or finely-structured metallic layer or an HRI (high refractive index) or LRI (low refractive index) layer. Such a dielectric reflective layer 20 consists, for example, of a vapor-deposited layer of a metal oxide, metal sulfide, titanium oxide etc. The layer thickness of such a layer is preferably 10 nm to 500 nm.

Preferably, the ink is applied to an adhesive layer 22 and/or to a primer layer at least in areas. Thus a multilayer film 10 is obtained in which at least one print 100 is arranged on the adhesive layer 22 and/or on the primer layer at least in areas. The adhesive layer 22, 22' can be applied both partially and over the whole surface. The adhesive layer can in principle also be a partial adhesive layer 22'. Likewise, it is conceivable that the adhesive layer is an adhesive layer 22 over the whole surface.

The ink is preferably formed such that the ink or the print 100 itself can serve as a partial adhesive layer 22'. In particular, an individualized bonding is thus obtained when the print 100 is individualized. However, it is also possible for the ink to be applied at least partially to the adhesive layer 22 for the passivation, in particular for the partial passivation of the adhesive layer 22. In the case of a later application or hot-stamping, a transfer of the multilayer film to a substrate is then effected only in the areas of the adhesive layer 22 not printed with ink.

The adhesive layer 22, 22' or the primer layer is preferably formed of PMMA, PVC, acrylates, polyamides, polyvinyl acetates, hydrocarbon resins, polyesters, polyurethanes, chlorinated polyolefins, polypropylene, epoxy resins and/or polyurethane polyols, in particular in combination with inactivated isocyanates. The adhesive layer 22 or the primer layer can moreover contain fillers, such as for example $SiO_2$ and/or $TiO_2$.

The layer thickness of the adhesive layer 22, 22' or the primer layer is preferably between 0.5 μm and 20 μm, particularly preferably between 1.5 μm and 5 μm. The adhesive layer or the primer layer can be produced by means of gravure printing, flexographic printing, screen printing, inkjet printing and/or by means of a slot die.

Advantageously, the ink is applied to a replication layer or a replication varnish 18, 24 at least in areas. Thus a multilayer film 10 is obtained in which at least one print 100 is arranged on the replication layer 18, 24 at least in areas.

The ink can be applied to a not-yet-replicated replication layer 24. The replication layer or the replication varnish 24 has in particular still-smooth surfaces. The replication is then effected in particular after the print 100 has been provided. Structures 28 can then be introduced into the print 100 and/or into the replication layer 24 through the replication. For example, a non-individualized item of information in the replication layer 18 can be combined with an individualized print 100. A replication in the print 100 can represent an additional protective measure against forgery because the print 100 is thereby yet more integrated into the overall system of the multilayer film 10.

Ideally, the ink is applied to a substantially smooth surface of the replication layer 18 or the replication varnish 24, wherein the surface is then preferably replicated at a later point in time, at least in areas.

It is however also possible for the ink to be applied to an already-replicated replication layer 18, thus also to a replication layer 18 which is already provided with a surface structure, a replication structure 28. The ink is preferably applied to the structured surface or to the replication structure 28, at least in areas.

If the ink is applied to an already-replicated replication layer 18 or a print 100 is provided on an already-replicated replication layer 18, at least partial areas of the structures 28, in particular of the diffractive structures can then be obliterated hereby, when the ink has a refractive index similar to the replication layer 18, in particular with a refractive index with a difference of less than 0.2. This occurs in particular when the ink is applied with a layer thickness which is greater than the depth of the structures. However, it is also possible for the ink to be applied in a smaller layer thickness in such a way that the ink or the print 100 follows the topology of the structures and thus in particular becomes part of the diffraction. This is conceivable in particular when a solvent ink is used.

Furthermore, the ink can also be applied in such a way that the ink or the print 100 only partially fills the replication structures 28, in particular diffractive structures on the surface of the replication layer 18. An only partial filling of the structures then occurs in particular when the finally-applied ink layer thickness is less than the depth of the replication structures 28. Under specific conditions the ink can also fill in the structures without an obliteration being optically effected. This is in particular the case when the ink has reflective or highly refractive properties and differs in its complex refractive index, in particular by more than 0.2, from the complex refractive index of the replication layer 18. An example of reflective inks are inks with metal effect pigments or metal flakes. An example of highly refractive inks are inks based on liquid crystals.

An ink is preferably applied to the replication layer 18, 24 with a layer thickness which is greater than the depth of the structures to be introduced into the replication layer 18, 24. In particular, the layer thickness of the applied ink is substantially twice as thick as the layer thickness of the structures to be introduced into the replication layer 18, 24. A layer thickness of the ink that is at least twice as great as the depth of the structures to be introduced into the replication layer is advantageous when a replication is carried out only after the application of the ink. It is thereby prevented that, during the replication, the structures introduced completely penetrate the applied ink.

In another embodiment example, the ink is preferably printed on with a layer thickness smaller than the depth of the structures to be introduced into the replication layer 18. During the replication, the ink can thereby be penetrated with the structures introduced through the entire layer of the print 100, whereby the print 100 can receive, through the continuous structures, a high-resolution fine structuring that is also visible from the carrier layer 12, which exceeds the print resolution of inkjet printers and thus represents a further security feature.

The replication layer 18 preferably has replication structures 28 on one of its upper sides, at least in areas. Diffractively and/or refractively acting micro- and/or macrostructures are preferably molded into the replication layer 18. The replication layer 18, 24 is preferably formed of acrylate, cellulose, PMMA and/or crosslinked isocyanates. The replication layer 18, 24 can also consist of a thermoplastic varnish. A surface structure 28 is preferably molded into the varnish by means of heat and pressure through the action of a stamping tool. Furthermore, it is also possible for the replication layer 18, 24 to be formed by a UV-crosslinkable varnish and the surface structure to be molded into the replication layer 24 by means of UV replication. The surface structure is molded onto the uncured replication layer 24 by the action of a stamping tool and the replication layer 18 is cured directly during or after the molding by irradiation with UV light.

In principle, the replication layer 18, 24 can be produced by means of the known printing methods. In particular, gravure printing, flexographic printing, screen printing or inkjet printing are suitable. Production by means of a slot die is, however, also possible.

The surface structure or replication structure 28 molded into the replication layer 18 preferably a diffractive surface structure, for example a hologram, Kinegram® or another optically diffractive active grating structure. Such surface structures typically have a spacing of the structural elements in the range of from 0.1 μm to 10 μm, preferably in the range of from 0.5 μm to 4 μm. Furthermore, it is also possible for the surface structure to be a zero-order diffraction structure. This diffraction structure preferably has, in at least one direction, a period smaller than the wavelength of visible light, between the half wavelength of visible light and the wavelength of visible light, or smaller than the half wavelength of visible light. Furthermore, it is possible for the surface structure to be a blazed grating. Particularly preferably, it is an achromatic blazed grating in this case. Such gratings preferably have, in at least one direction, a period of between 1 μm and 100 μm, further preferably between 2 μm and 10 μm. However, it is also possible for the blazed grating to be a chromatic blazed grating. Furthermore, it is preferable that the surface structure is a linear or crossed sinusoidal diffraction grating, a linear or crossed single- or multi-step rectangular grating. The period of this grating preferably lies in the range between 0.1 μm and 10 μm, preferably in the range 0.5 μm to 4 μm. Further preferably, the surface structure is an asymmetrical relief structure, for example an asymmetrical saw-tooth structure. The period of this grating preferably lies in the range between 0.1 μm and 10 μm, preferably in the range 0.5 μm to 4 μm. Further preferably, the surface structure is a light-diffracting and/or light-refracting and/or light-focusing micro- or nanostructure, a binary or continuous Fresnel lens, a binary or continuous Fresnel freeform surface; a diffractive or refractive macrostructure, in particular a lens structure or microprism structure, a mirror surface or matte structure, in particular an anisotropic or isotropic matte structure, or a combination structure of several of the above-named surface structures.

The structure depth of the above-named surface structures or replication structures 28 preferably lies in the range between 10 nm and 10 μm, further preferably between 100 nm and 2 μm.

The replication layer 18, 24 preferably has a layer thickness of between 200 nm and 5 μm. If the replication layer has a diffractive surface structure, then the layer thickness is preferably between 0.3 μm and 6 μm. If the replication layer has coarser structures, in particular with a greater period and/or greater depth, for example a so-called "surface relief", then the layer thickness is preferably between approximately 1 μm and 10 μm. If the replication layer has a lens-shaped surface structure, then the layer thickness is preferably between 1.5 μm and 10 μm.

The replication or structuring of a surface of the replication layer can be effected in different ways. In the case of thermoplastic replication layers, a thermal replication is effected, in particular under the effect of heat and/or pressure. A print 100 may already have been applied to the replication layer 24 at this point in time. In this case the print 100 or the ink has substantially been applied to a smooth surface of the replication layer.

It is also conceivable that a UV replication is effected. If the print 100 is formed with a UV-curable ink, the UV print can be advantageously protected with the UV-curing replication varnish 24. Reactive groups which "crosslink to" the UV-curable replication varnish 24 are located on the surface of the UV-curable ink. The crosslinking and thereby also the stability of especially thin prints with UV-curing inks can in particular be improved because, through encapsulation in the UV-replication varnish during the UV curing, the inhibition effects that are then active in particular in the case of thin UV-curing layers are minimized. Through the described encapsulation, a smaller layer thickness of the print formed with the UV-curing ink can also be realized without complex and expensive inertization measures.

Mechanical stresses due to contact pressures and/or thermal stresses, as in the case of thermal replication, can also be reduced.

Preferably, the replication layer is provided with a reflective layer which can consist of a metal layer or a metallization and/or an HRI layer with a high refractive index (HRI). The reflective layer can be opaque, semi-transparent or transparent, wherein the transparency can be, in particular, dependent on the observation angle.

It is expedient if the multilayer film 100, at least in areas, has an adhesion-promoter layer which can in principle be arranged on each layer of the multilayer film 10 and/or underneath and/or on the print 100. The adhesion-promoter layer is preferably applied only in those areas to which the ink is then also applied later.

The adhesion-promoter layer ensures, in particular, that there is good adhesion between the layers connected thereto. A delamination can hereby be prevented so far as possible. In particular, the adhesion-promoter layer prevents an unwanted predetermined breaking point from forming in the case of a cured print 100.

In particular PVC, mixtures of thermally and UV-curing acrylates, adhesion-promoter layers with adhesion-improving surface additives, such as for example functional acrylates, hydroxy-functional copolymers, block copolymers (from e.g. BYK or TEGO), plasma and/or corona treatments and/or also seedings by metal vapor deposition are conceivable as adhesion-promoter layer.

The adhesion-promoter layer can preferably be produced by means of gravure printing, screen printing, slot die, flexographic printing, inkjet printing, and/or spray varnishing. The adhesion-promoter layer preferably has a layer thickness of between 0.1 μm and 1.5 μm during printing. We the adhesion-promoter layer is produced by means of vapor deposition, then the layer thickness is preferably between 1 nm and 50 nm.

Furthermore, the multilayer film 10 can have an anti-adhesion layer. The anti-adhesion layer can in principle be arranged on each layer of the multilayer film 10 and/or on the print 100. The anti-adhesion layer is preferably formed of silicon acrylates, fluorinated polymers and/or waxes.

It is advantageous if the ink is applied to a layer of the multilayer film 10, in particular to the carrier layer 12, the detachment layer 14, the replication layer 18, the reflective layer 20, the adhesive layer 22 and/or the protective layer 16, with the interposition of at least one adhesion-promoter layer and/or anti-adhesion layer.

Furthermore, the multilayer film 10 can, at least in areas, have a layer with interference pigments and/or at least one volume hologram. Preferably in addition, at least one light-absorbing, preferably an opaque, particularly preferably a black print 100 is arranged in the multilayer film 10 at least in areas.

The layer with interference pigments and/or the volume hologram can also be applied over the whole surface or in the form of patches, in the form of strips or as an extensive overlay film, wherein in this case the print 100, in particular the light-absorbing and/or opaque and/or black print is formed only partially or in areas. This creates the impression that the interference pigments and/or the volume hologram are applied only locally, namely in that area which is provided by the print, because the optical effects stand out above all in that area which is provided by the print 100.

Interference pigments are generally known, and have an optically variable color change effect in the case of changing observation and/or illumination angles. The pigments are often transparent or translucent and, because of this, can only be seen with difficulty on light backgrounds, or not at all, and the color change is then also correspondingly weak. Volume holograms are generally known, and have an optically variable effect in the case of changing observation and/or illumination angles. Volume holograms are often transparent or translucent and, because of this, can only be seen with difficulty on light backgrounds, or not at all, and the optically variable effect is then also correspondingly weak. The print 100 formed light-absorbing or opaque ensures in particular that the interference pigments and/or the volume hologram stand out better or become visible. The print 100 is preferably formed substantially black.

Figure 2:
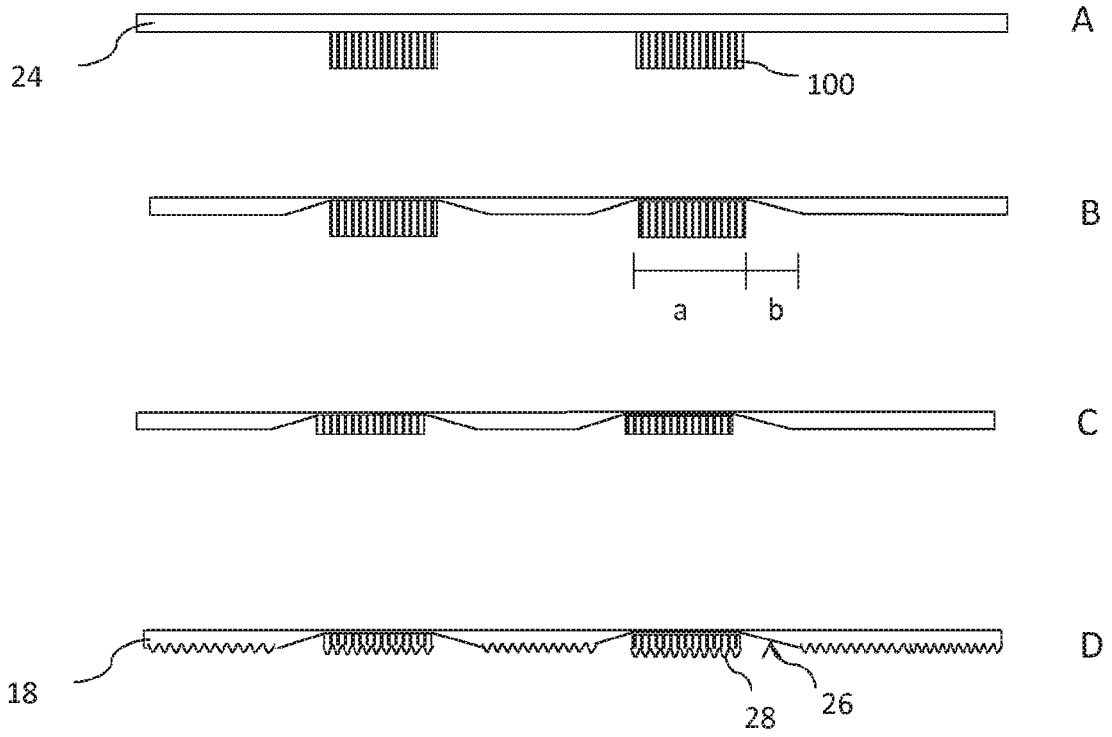

FIG. 2 shows a schematic process of the application of a print 100 to a replication layer 18 or to a replication varnish 24 with subsequent replication.

In a first step A, an ink is applied to a replication varnish 24 at least in areas. At least one print 100 is provided hereby.

In principle, the ink according to the invention is not limited to any specific design. The ink can be formed transparent, translucent, opaque, invisible, colored and/or colorless. In principle, the print 100 is likewise limited to a specific design. The print 100 can be formed transparent, translucent, opaque, invisible, colored and/or colorless.

The ink can be a fluorescent ink, both a transparent and a colored fluorescent ink, and/or a luminescent ink, both transparent and colored luminescent ink, and/or phosphorescent, including chemoluminescent inks, both transparent and colored phosphorescent ink, and/or liquid crystalline ink, in particular with dichroic color effects and/or inks with taggants and/or with laser-sensitive pigments.

Both light-curing, in particular UV-curing inks and solvent and/or aqueous inks can be used.

The thickness of the ink layer applied or printed preferably lies between 0.1 μm and 30 μm, in particular between 0.5 μm and 15 μm, particularly preferably between 0.5 μm and 15 μm and advantageously between 1 μm and 3 μm. If solvent and/or aqueous inks are used, the layer thickness is then preferably approximately 0.5 μm. If UV-curing inks are used, the layer thickness is then approximately between 1 μm and 30 μm, preferably between 1 μm and 15 μm, particularly preferably between 1 μm and 8 μm.

The print 100 is preferably formed through the application of a single ink. In principle, it is conceivable that in a subsequent step the print 100 is further processed, at least in areas, in particular irradiated. The optical appearance of the print 100 is hereby preferably changed in these areas. A print 100 can thus be obtained which—although it consists of only a single ink—comprises at least two areas which differ in their optical appearance. The print 100 can thus preferably have at least one visible and at least one invisible area.

The print 100 can also be formed through the application of several inks, in particular formed differently from each other. The several inks differ from each other in particular in their optical appearance and/or their composition. The inks can thus, for example, differ from each other in their color. However, it is also conceivable that at least one of the inks used is transparent and/or invisible and at least one other ink used is formed opaque and/or visible. The inks can be printed next to each other, one on top of the other or also overlapping. In an optionally subsequent step, when a corresponding ink is used, it is possible for the print 100 to be processed and/or irradiated at least in areas, in particular in that area where the transparent ink is located. The transparent or invisible ink can hereby become visible and preferably complement a partial motif or the like produced by the visible or opaque ink, whereby in particular an overall motif appears.

If several, in particular differently formed inks are applied to provide the at least one print 100, then the inks can be arranged next to each other, in particular directly next to each other, or overlapping at least in areas. The inks can however also be printed one on top of the other. The application of the several inks can be effected both simultaneously and overlapping in time and also sequentially in time. For example, in the case of inkjet printers, the application is effected sequentially in time. In particular one color per head is printed. In particular, it is not possible in this case for several heads to be in the same place at the same time. In the Hewlett Packard Indigo method, the final transfer of all the inks is preferably effected simultaneously, as the print image is printed onto a transfer blanket beforehand or is built up there from individual single-colored inks and is only subsequently transferred from this transfer blanket onto the target substrate.

Steps B to D substantially represent the replication. During the replication, both at least areas of the replication layer 18 and the print 100 applied thereto are replicated. In particular, a replication which lies in register with the print 100 is thus obtained. In particular, a tolerance of replication to print is achieved within +/−1.0 mm, preferably within +/−0.7, particularly preferably less than +/−0.4 mm.

It is expedient if the ink is applied in such a way that, during a replication into the area a covered by the print 100, the replication structure 28 introduced is impressed only into the print 100, and not into the replication layer 24.

Before the replication, the print 100 preferably has a thickness which is greater than the depth of the replication structure introduced into the print 100. In particular, the print has a layer thickness of between 0.5 μm and 6 μm. Before the replication, the layer thickness of the applied print 100 is preferably approximately twice as thick as the depth of the structure introduced into the replication layer 24.

During the replication, the print 100 is preferably pressed into the replication layer 24 (step B). This is substantially to be understood to the effect that, in particular those areas a of the replication layer 24 on which the print 100 is arranged, lose layer thickness.

In this case the thickness of the replication layer 24 in the area a of the print 100 decreases, preferably homogeneously or uniformly over this area. In the areas b of the replication layer 24 which, in a top view onto the multilayer film 10, are arranged adjacent to the print 100, thus adjoin the print 100, the layer thickness of the replication layer 24 decreases less as the distance from the print 100 increases, in particular during the replication. There is substantially a linear increase in the layer thicknesses.

The print 100 is preferably compressed during the replication (step C). It is hereby in particular possible for the print 100, as also the replication layer 18, to be replicated together at least in areas.

In a method step D, the print 100 is replicated together with the replication varnish 24. A replication structure 28 is introduced at least in areas. The replication structure 28 is advantageously introduced in such a way that an area b of the replication layer which is arranged adjacent to the print 100 in a top view onto the multilayer film 10, is not replicated. This area is referred to as a corona 26 in the present case. During a replication, the area b, the corona 26, preferably does not come into contact with a replication tool. In a top view onto the multilayer film 10, the area in particular directly adjoins the print 100. The size of the area of the replication layer which is not replicated depends in particular on the application thickness of the ink and/or the strength with which it is pressed into the replication layer 18. For example, the corona 26 substantially has a width of between 1 μm and 100 μm.

If the ink is applied to a not-yet replicated replication layer 24, then an adhesion-promoter layer can often be dispensed with. Experience has shown that the replication of the replication layer 24 together with the print 100 brings about an improved adhesion of the print 100 on the replication layer 18. Moreover, replication together also brings about a surface roughening of the print 100, whereby subsequent layers also adhere well to the print 100.

Figure 3:
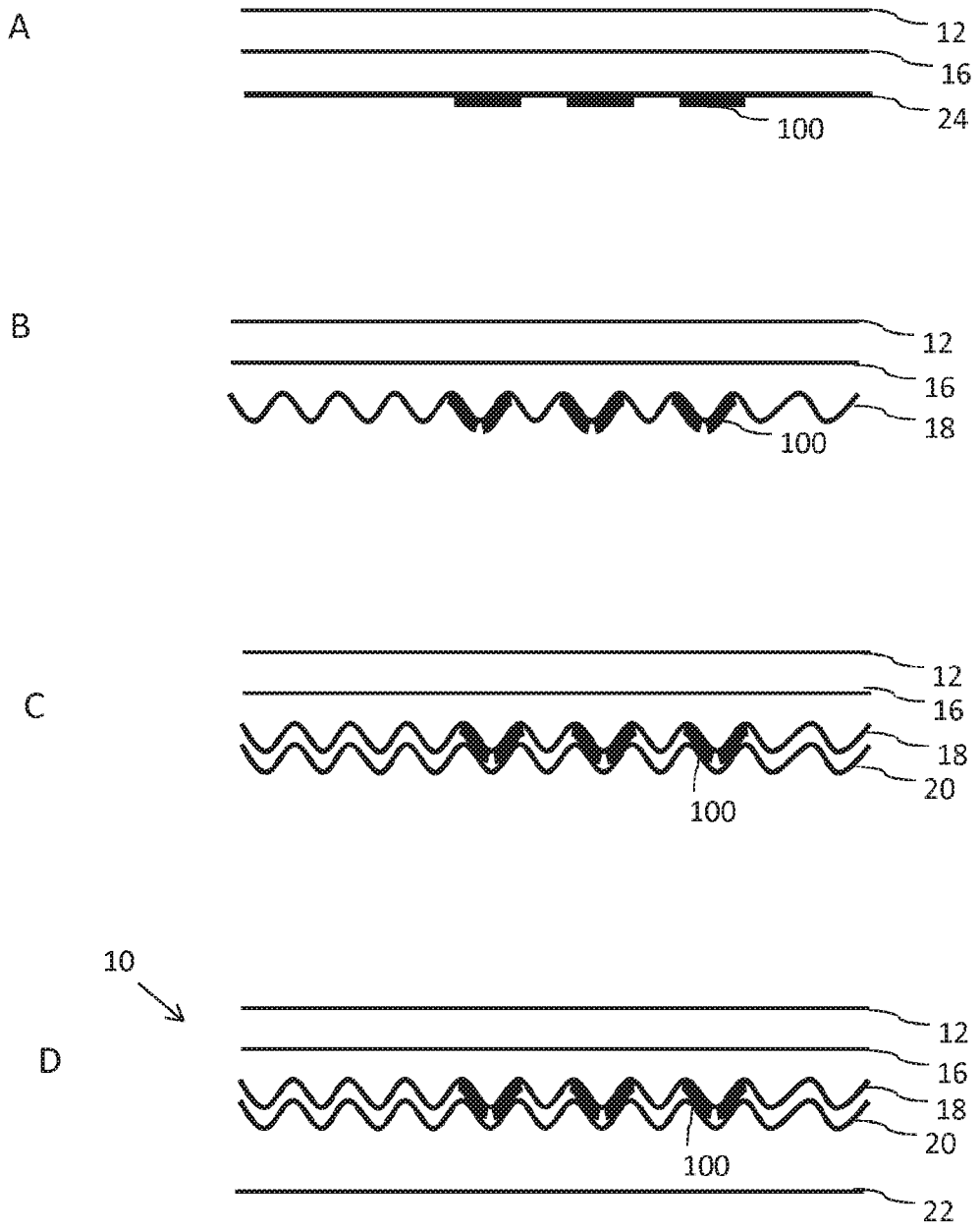

FIG. 3 shows a schematic process of production of a multilayer film 10 in one embodiment. In a first step A, a carrier layer 12 is provided. A detachment layer 14 can be applied to the carrier layer 12 at least in areas. The presence of a detachment layer is advantageous when the multilayer film 10 is formed as transfer film and the carrier layer 12 is to be removed after application of the multilayer film 10 to a substrate. However, the presence of a detachment layer 14 is not necessary. In particular when the multilayer film is formed as laminating film, a detachment layer should be dispensed with.

Furthermore, a protective layer 16 is provided. A replication layer or a replication varnish 24 is then advantageously applied to the protective layer 16. The replication layer or the replication varnish 24 is preferably a layer which has not yet been replicated, thus does not yet have any replication structures 28 and/or in particular which has substantially still-smooth surfaces. At least one ink is preferably applied to the replication layer or to the replication varnish 24 by means of inkjet printing. A print 100 is provided hereby. It is pointed out that the layer thickness ratios do not necessarily correspond to the real layer thickness ratios.

Now the print 100 and the replication varnish 26 or the replication layer 18 are then replicated together in a step B. A replication structure 28 is thus preferably molded or introduced into the print 100 and/or the replication layer or the replication varnish 26. Even if the replication structure 28 extends over the whole surface in step B, this is not absolutely necessary in the present case. The replication structure 28 or replication structures can also be introduced into the print 100 or into the replication layer 18 only in areas.

In a step C, a reflective layer 20 is applied to the print 100 and/or to the replication layer 18 or the replication varnish 24. The reflective layer 20 is preferably a metal layer or metallization. The reflective layer 20 can be applied both in areas and over the whole surface. Advantageously, the reflective layer 20 is first applied substantially over the whole surface and then partially removed again. The lift-off method is suitable for this. This is advantageous in particular when a print 100 which is formed as a wash varnish is provided. In this case the print 100 is preferably applied in the form of a desired design and then overlaid or covered with the metallization and/or at least one further varnish. The print 100 can then be removed again by a solvent treatment, together with parts of the further layer or the further layers, with the result that the further layer or the further layers, in particular the metallization or the reflective layer 20, remain only where no print 100 was applied beforehand. For the provision of a print 100 as a wash varnish, in particular an ink which comprises polyvinylpyrrolidones and/or methyl cellulose is provided.

An adhesive layer 22 is then also applied in a further step D. The adhesive layer 22 can be applied both over the whole surface and also partially.

Figure 4:
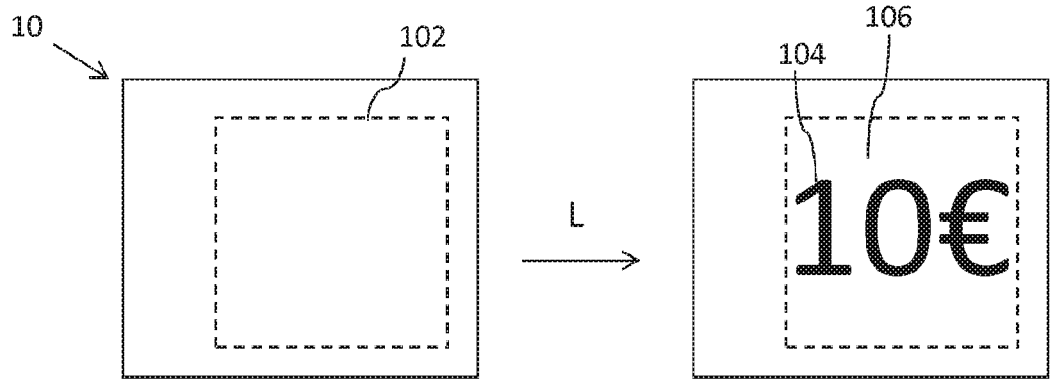
Figure 5:
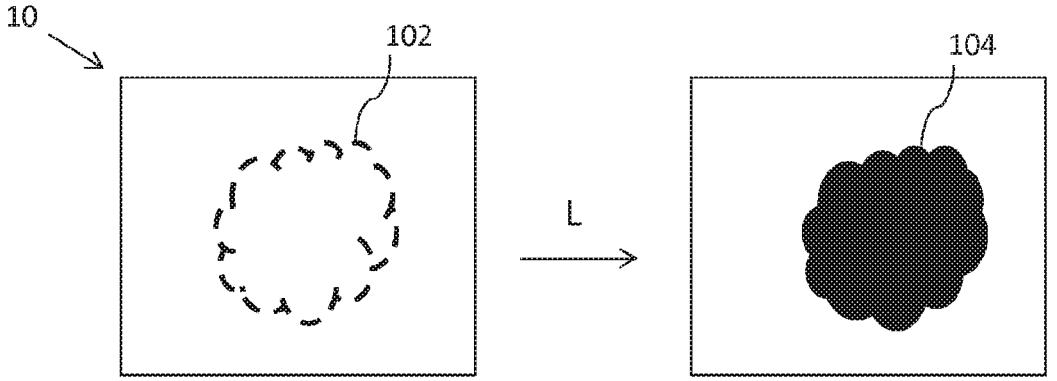
Figure 6:
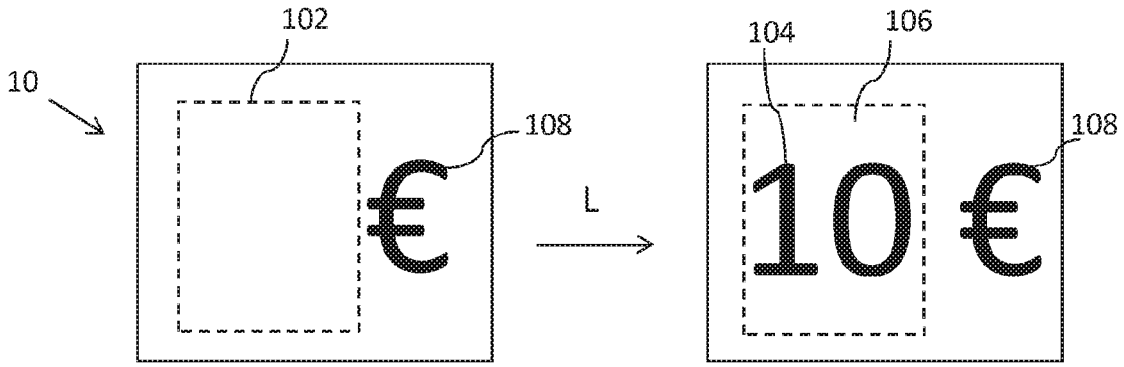

FIGS. 4 to 6 each show a schematic representation of a multilayer film 10 in an embodiment before and after laser irradiation L.

An ink which comprises laser-sensitive pigments is preferably provided for this. The pigments can be, for example, ammonium octamolybdates (AOM). The laser-sensitive pigments offer the advantage that an in particular further individualization or personalization of the multilayer film 10 and/or of the print 100, 102 is hereby made possible downstream of the printing.

The ink having the laser-sensitive pigments can be formed transparent or translucent or also colored at least in areas. If the laser-sensitive pigments or the ink or the print 100 comprising the laser-sensitive pigments are exposed for example to laser radiation L, then the optical appearance of the pigments in particular changes. The pigments undergo in particular a color change or a blackening.

The complementary individualization or personalization can be effected both during the manufacture of the multilayer film 10 and after manufacture of the film 10, in particular after the application of the film 10 to a substrate, in particular to a security document.

It is also conceivable for the print 100, 102 to be irradiated several times, whereby in particular a first complementary individualization or personalization and at least one further complementary individualization or personalization is created. The irradiations are preferably effected at different points of the print 100, 102. However, it is also possible for the irradiations or the irradiation areas to overlap.

The several irradiations can all be effected during the manufacture of the multilayer film 10 or also partially during the manufacture and partially after the manufacture, in particular after an application of the multilayer film 10 to a substrate, or also all be effected after the manufacture. It is advantageous if the first complementary individualization is effected during the manufacture of the multilayer film 10 and at least one further individualization is effected after the manufacture of the film 10, in particular after the application of the film to a substrate.

The print 102 represented in FIG. 4 is formed as a rectangular area. In particular, a transparent or invisible ink has been applied to a layer for this. The print 102 is thus invisible before the laser irradiation and thus is not in principle visible to a human observer. At least a part of the print 102 is irradiated with a laser L, whereby this part 104 is made visible, for example a blackening can occur. The other parts 106 of the print continue to remain invisible. In principle it is also conceivable that the print 102 was already formed visible or colored before the laser treatment L, and its optical appearance changes through the laser treatment L, whereby the irradiated area 106 differs from the remaining area 106 of the print.

The print 102 represented in FIG. 5 is formed cloud-shaped. Before a laser irradiation L, the print 102 can be formed invisible. The print 102 is preferably completely irradiated with a laser whereby the print 104 becomes visible, in particular turns black. It is however also conceivable in principle that, before the laser treatment L, the print 102 is formed visible, in particular colored, and changes in its optical appearance through the laser irradiation L, in particular a color change and/or a bleaching-out and/or a blackening occurs.

Several possibilities are conceivable for the production of the further or complementary individualization. One possibility consists, for example, in the application of an invisible ink. The ink can be applied either over the whole surface or in areas, in particular as a motif. The irradiation of the ink in areas or also completely is then effected subsequently. Thus either only areas of the ink or else the entire surface printed with ink are hereby made visible. It is advantageous if only areas of the applied ink are irradiated.

FIG. 6 shows a print 102 which is arranged adjacent to a motif 108. The print 102 is preferably provided through the application of a transparent and/or invisible ink. The print 102 represented in FIG. 6 is thus formed transparent and/or invisible. However, the print 102 can in principle also be formed colored and/or opaque.

The motif 108 can be an ink or a print within the meaning of the invention. It is however also possible for the motif 108 to be any coding, any decoration, a decorative design and/or a motif, which is arranged on any layer of the multilayer film. The motif does not have to have been created or produced in a specifically stipulated manner.

The print 102 is preferably irradiated such that the irradiated area 104 of the print forms an overall motif with the visible motif 108.

Figure 7:
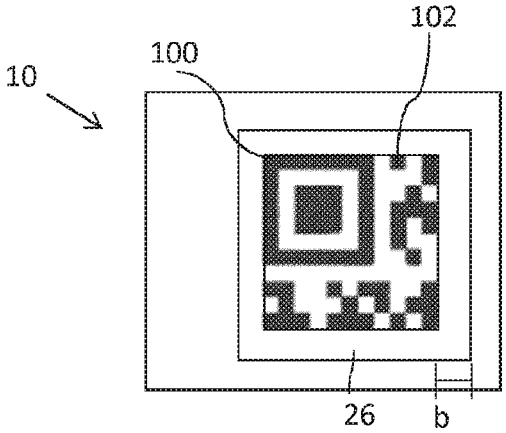
Figure 8A:
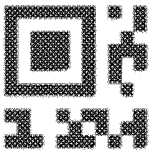
Figure 8B:
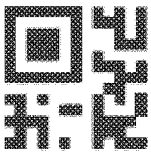
Figure 8C:
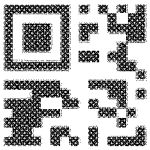
Figure 8D:
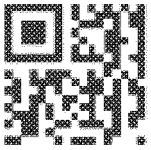

FIG. 7 shows a schematic top view onto a multilayer film 10 with a print 100 in an embodiment. The print 100 is formed as a code, in particular as a data matrix code, as a QR code and/or a micro QR code. The QR code as well as the micro QR code are composed of a plurality of code elements 108. It is advantageous if the individual code elements 108 are in turn composed of a plurality of ink droplets. In particular, observed in one direction, in particular in the X direction, at least 2, preferably 4 ink droplets are printed for the provision of a code element 108. In particular 2×2, preferably 4×4 ink droplets are thus printed or required for a code element in the case of two-dimensional observation. The more ink droplets, the better and the cleaner the edges of the code element 108 and thus also of the code emerge.

The print 100 represented in FIG. 7 is surrounded by a corona 26. The corona 26 is in particular an area in the replication layer or the replication varnish 24, which is not provided with a replication structure. The corona 26 can promote the visibility or the recognition of the print 100. The corona 26 serves in particular as a contrast-enhancing means. The width of the corona 26 is in particular between 1 μm and 100 μm.

FIGS. 8*a* to 8*d* show schematic top views of a print 100 in further embodiments. The prints 100 represented in FIGS. 8*a* to 8*d* are formed as micro QR codes. The micro QR code represented in FIG. 8*a* has 11×11 code elements 108, the micro QR code represented in FIG. 8*b* has 13×13 code elements 108, the micro QR code represented in FIG. 8*c* has 15×15 code elements 108, and the micro QR code represented in FIG. 8*d* has 17×17 code elements 108.

The micro QR codes can have a size of 3 mm or 5 mm. If a micro OR code has an overall size of 3 mm and it comprises 11×11 code elements 108, each code element 108 has a size of 272.7 μm. If a micro QR code has an overall size of 3 mm and it comprises 13×13 code elements 108, each code element 108 has a size of 230.8 μm. If a micro QR code has an overall size of 3 mm and it comprises 15×15 code elements 108, each code element 108 has a size of 200 μm. If a micro QR code has an overall size of 3 mm and it comprises 17×17 code elements 108, each code element 108 has a size of 176.5 μm.

If a micro QR code has an overall size of 5 mm and it comprises 11×11 code elements 108, each code element 108 has a size of 454.5 μm. If a micro QR code has an overall size of 5 mm and it comprises 13×13 code elements 108, each code element 108 has a size of 384.6 μm. If a micro OR code has an overall size of 5 mm and it comprises 15×15 code elements 108, each code element 108 has a size of 333.3 μm. If a micro QR code has an overall size of 5 mm and it comprises 17×17 code elements 108, each code element 108 has a size of 294.1 μm.

The values are summarized in the following table:

| Micro QR code Number of code elements | 3 mm Micro QR code Size of code element in X direction (μm) | 5 mm Micro QR code Size of code element in X direction (μm) |
|---|---|---|
| 11 × 11 | 272.7 | 454.5 |
| 13 × 13 | 230.8 | 384.6 |
| 15 × 15 | 200.0 | 333.3 |
| 17 × 17 | 176.5 | 294.1 |

Depending on how large the ink droplets are formed, the individual code elements 108 are then composed of several ink droplets. Examples of this are given in the following table:

| Micro QR code 3 mm | Number of ink droplets from which a code element is composed in each case | | | |
|---|---|---|---|---|
| Size of an ink droplet (μm) | 11 × 11 code elements | 13 × 13 code elements | 15 × 15 code elements | 17 × 17 code elements |
| 84.7 | 3.22 | 2.73 | 2.36 | 2.08 |
| 70.6 | 3.87 | 3.27 | 2.83 | 2.50 |
| 42.3 | 6.44 | 5.45 | 4.72 | 4.17 |
| 28.2 | 9.66 | 8.18 | 7.09 | 6.25 |
| 21.2 | 12.88 | 10.90 | 9.45 | 8.34 |

| Micro QR code 5 mm | Number of ink droplets from which a code element is composed in each case | | | |
|---|---|---|---|---|
| Size of an ink droplet (μm) | 11 × 11 code elements | 13 × 13 code elements | 15 × 15 code elements | 17 × 17 code elements |
| 84.7 | 5.37 | 4.54 | 3.94 | 3.47 |
| 70.6 | 6.44 | 5.45 | 4.72 | 4.17 |
| 42.3 | 10.74 | 9.09 | 7.87 | 6.95 |
| 28.2 | 16.11 | 13.63 | 11.81 | 10.42 |
| 21.2 | 21.47 | 18.17 | 15.75 | 13.90 |

Figure 9A:
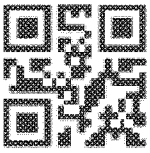
Figure 9B:
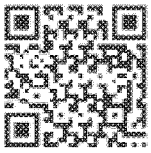

FIGS. 9*a* and 9*b* show schematic top views onto a print 100 in further embodiments. The prints 100 represented in FIGS. 9*a* and 9*b* are formed as OR codes. The QR code represented in FIG. 9*a* has 22×22 code elements 108, and the QR code represented in FIG. 9*b* has 32×32 code elements 108.

The QR codes can have a size of 3 mm or 5 mm. If a OR code has an overall size of 3 mm and it comprises 22×22 code elements 108, each code element 108 has a size of 136.4 μm. If a QR code has an overall size of 3 mm and it comprises 32×32 code elements 108, each code element 108 has a size of 93.8 μm.

If a QR code has an overall size of 5 mm and it comprises 22×22 code elements 108, each code element 108 has a size of 227.3 μm. If a QR code has an overall size of 5 mm and it comprises 32×32 code elements 108, each code element 108 has a size of 156.3 μm.

The values are summarized in the following table:

| QR code Number of code elements | 3 mm QR code Size of code element in X direction (μm) | 5 mm QR code Size of code element in X direction (μm) |
|---|---|---|
| 22 × 22 | 136.4 | 227.3 |
| 32 × 32 | 93.8 | 156.3 |

Depending on how large the ink droplets are formed, the individual code elements 108 are then composed of several ink droplets. Examples of this are given in the following table:

| QR code 3 mm | Number of ink droplets from which a code element is composed in each case | |
|---|---|---|
| Size of an ink droplet (μm) | 22 × 22 code elements | 32 × 32 code elements |
| 84.7 | 1.61 | 1.11 |
| 70.6 | 1.93 | 1.33 |
| 42.3 | 3.22 | 2.21 |
| 28.2 | 4.83 | 3.32 |
| 21.2 | 6.44 | 4.43 |

| QR code 5 mm | Number of ink droplets from which a code element is composed in each case | |
|---|---|---|
| Size of an ink droplet (μm) | 22 × 22 code elements | 32 × 32 code elements |
| 84.7 | 2.68 | 1.85 |
| 70.6 | 3.22 | 2.21 |
| 42.3 | 5.37 | 3.69 |
| 28.2 | 8.05 | 5.54 |
| 21.2 | 10.74 | 7.38 |

Figure 10A:
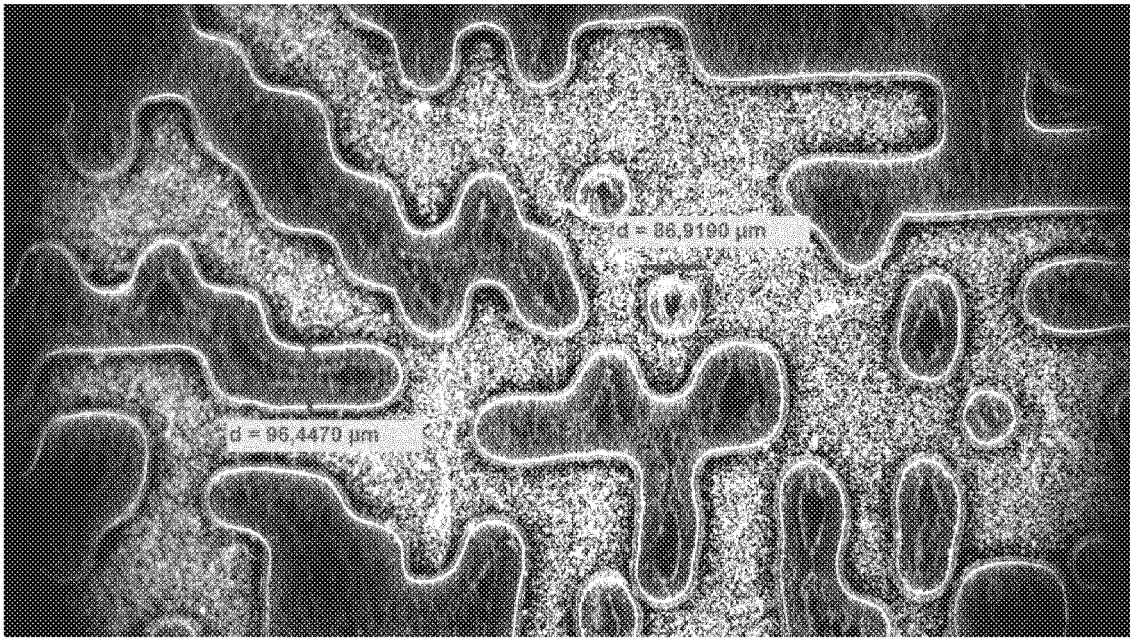
Figure 10B:
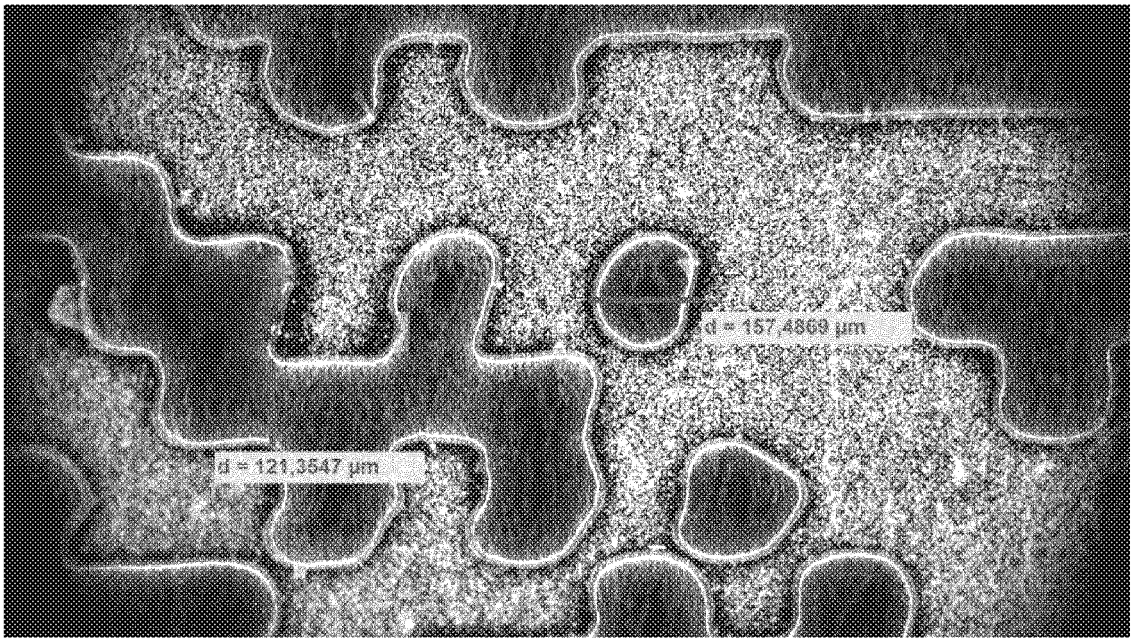

FIG. 10*a* shows a microscope image (100×) of a 3 mm QR code with 32×32 code elements, wherein the QR code has been printed with 600 dpi. FIG. 10*b* shows a microscope image (100×) of a 5 mm QR code with 32×32 code elements, wherein the QR code has been printed with 600 dpi. Values or dimensions of individual code elements are represented in the figures.

LIST OF REFERENCE NUMBERS

10 multilayer film
12 carrier layer
14, 14' detachment layer (over the whole surface, partial)
16 protective (varnish) layer
18 replication layer
20 reflective layer
22, 22' adhesive layer (over the whole surface, partial)
24 replication varnish (non-replicated replication layer)
26 corona
28 replication structure
30 (partial) marking/(partial) motif
100 print
102 print before laser treatment
104 visible area of the print after laser treatment
106 non-visible area of the print after laser treatment
108 code element
a printed-over area
b width of corona
L laser treatment

The invention claimed is:

1. A method for producing a multilayer film, wherein, in at least one step, at least one ink is applied to a layer by means of inkjet printing, whereby a first print is provided in at least one area, and wherein the first print is covered by at least one further layer, and wherein the ink is applied to a replication layer at least in areas, and wherein the replication layer is replicated together with the print applied thereto, whereby a replication structure is impressed into the replication layer and the print, and wherein during the replication of the replication layer, the print is pressed into the replication layer and/or compressed and/or deformed, and wherein the replication is effected in register with the print.

2. The method according to claim 1, wherein an individualized print is provided.

3. The method according to claim 1, wherein the print is formed through an application of a single ink.

4. The method according to claim 1, wherein the print is formed through an application of several inks.

5. The method according to claim 1, wherein the ink is applied to several layers of the multilayer film.

6. The method according to claim 1, wherein the ink is applied to a carrier layer at least in areas.

7. The method according to claim 1, wherein the ink is applied to a detachment layer at least in areas.

8. The method according to claim 1, wherein the ink is applied to a protective layer at least in areas.

9. The method according to claim 1, wherein the ink is applied, at least in areas, to a reflective layer.

10. The method according to claim 1, wherein the ink is applied to an adhesive layer and/or to a primer layer at least in areas.

11. The method according to claim 1, wherein the ink, or a print of a UV-curing replication varnish is poured-over, layered-over and/or encapsulated.

12. The method according to claim 11, wherein the application of the ink, or the provision of the print is carried out in the same manufacturing step as a UV replication.

13. The method according to claim 1, wherein the ink and a UV-curing replication varnish are cured together and/or the ink undergoes post-crosslinking through curing of the UV-curing replication varnish.

14. The method according to claim 1, wherein the ink is applied to a substantially smooth surface of the replication layer.

15. The method according to claim 1, wherein a position of the replication structure with respect to the print is within +/−0.4 mm.

16. The method according to claim 1, wherein the ink applied to the replication layer has a layer thickness substantially twice as thick as a depth of the replication structure introduced into the replication layer during the replication.

17. The method according to claim 1, wherein an adhesion-promoter layer is applied to a layer and/or to the ink or to the print at least in areas.

18. The method according to claim 17, wherein the at least one adhesion-promoter layer is applied only in those areas to which the ink is also applied.

19. The method according to claim 1, wherein an anti-adhesion layer is applied, at least in areas, to a layer of the multilayer film and/or to the ink or to the print.

20. The method according to claim 1, wherein an ink with laser-sensitive pigments is provided.

21. The method according to claim 1, wherein the ink or the print is irradiated at least in areas by means of a radiation source, whereby an optical appearance of the print changes.

22. The method according to claim 21, wherein at least one invisible and/or transparent ink is applied and the ink or the print is irradiated with a laser at least in areas, whereby the irradiated areas become visible.

23. The method according to claim 21, wherein at least one ink is applied adjacent to at least one visible marking and/or partial marking and/or to at least one visible motif and/or to a visible partial motif and the ink or the print is irradiated with a laser at least in areas, whereby the irradiated areas of the ink or the print become visible and, together with the adjacent marking and/or the adjacent partial marking and/or the adjacent motif and/or the adjacent partial motif, form an overall marking or an overall motif.

24. The method according to claim 21, wherein at least one visible and/or colored and/or opaque ink is applied and the ink or the print is irradiated with a laser at least in areas, whereby an optical appearance of the irradiated areas change.

25. The method according to claim 1, wherein at least one light-absorbing, print is provided at least in areas.

26. A method for producing a multilayer film, wherein, in at least one step, at least one ink is applied to a layer by means of inkjet printing, whereby a first print is provided in at least one area, and wherein the first print is covered by at least one further layer, and wherein the ink is applied to a replication layer at least in areas, and wherein the replication layer is replicated together with the print applied thereto, whereby a replication structure is impressed into the replication layer and the print, and wherein the print is compressed and/or deformed during the replication.

27. The method according to claim 26, wherein the replication is effected in register with the print.

28. A method for producing a multilayer film, wherein, in at least one step, at least one ink is applied to a layer by means of inkjet printing, whereby a first print is provided in at least one area, and wherein the first print is covered by at least one further layer, and wherein a surface of a replication layer is replicated, whereby at least one diffractive structure is impressed into the surface of the replication layer, and wherein the ink is applied to the replicated surface of the replication layer at least in areas, and wherein the ink is applied in such a way that the ink only partially fills the at least one diffractive structure on the surface of the replication layer.

29. A method for producing a multilayer film, wherein, in at least one step, at least one ink is applied to a layer by means of inkjet printing, whereby a first print is provided in at least one area, and wherein the first print is covered by at least one further layer, and wherein a print, which is formed as a wash varnish, is provided, and wherein a metal layer and/or a metallization is applied, and the wash varnish is then removed by a solvent treatment together with parts of the metal layer and/or the metallization, whereby the metal layer and/or the metallization remains only where no wash varnish has been applied.

30. The method according to claim 29, wherein the ink is applied to a replication layer at least in areas.

31. The method according to claim 30, wherein the replication layer is replicated together with the print applied thereto.

32. The method according to claim 31, wherein during the replication, the print is pressed into the replication layer.

33. The method according to claim 30, wherein the ink is applied in such a way that, during a subsequent replication, a replication structure is impressed into the print, but not into an area of the replication layer covered by the print.

34. The method according to claim 30, wherein, during a subsequent replication, a replication structure is introduced in such a way that an area of the replication layer is not replicated.

35. A multilayer film, having at least a first print, wherein the print is produced by means of inkjet printing and wherein the print is arranged within the multilayer film and is covered by further layers of the multilayer film, and wherein the multilayer film has an anti-adhesion layer at least in areas, and wherein the print is arranged on a replication layer, and wherein the print is replicated at least in areas, whereby a replication structure is impressed into the print.

36. The multilayer film according to claim 35, wherein the print is formed by a single ink.

37. The multilayer film according to claim 35, wherein a position of the replication structure with respect to the print is within +/−0.2 mm provided.

38. The multilayer film according to claim 35, wherein at least one area of the replication layer, which, in a top view onto the multilayer film is arranged adjacent to the print, is not replicated.

39. The multilayer film according to claim 35, wherein the areas in which the print is replicated comprise replication structures, and wherein in those areas in which the applied ink or the print is present, the ink or the print only partially fills the replication structures.

40. The multilayer film according to claim 35, wherein the multilayer film has an adhesion-promoter layer at least in areas.

41. The multilayer film according to claim 35, wherein the ink or the print comprises laser-sensitive pigments.

42. The multilayer film according to claim 35, wherein the print has visible and invisible areas.

* * * * *